US006795669B2

(12) United States Patent
Yamauchi et al.

(10) Patent No.: US 6,795,669 B2
(45) Date of Patent: Sep. 21, 2004

(54) IMAGE DEVICE WITH CONTROL MEMBERS FOR ROLLERS

(75) Inventors: Hirokazu Yamauchi, Uji (JP); Tatsuya Inoue, Nara (JP); Shinichi Takeda, Osaka (JP); Hiroshi Kida, Yamatokoriyama (JP); Yoshiaki Masuda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 53 days.

(21) Appl. No.: 10/060,326

(22) Filed: Feb. 1, 2002

(65) Prior Publication Data

US 2002/0106224 A1 Aug. 8, 2002

(30) Foreign Application Priority Data

| | | |
|---|---|---|
| Feb. 2, 2001 | (JP) | P2001-027198 |
| Mar. 21, 2001 | (JP) | P2001-081548 |
| Mar. 21, 2001 | (JP) | P2001-081590 |
| Mar. 23, 2001 | (JP) | P2001-084528 |

(51) Int. Cl.[7] ..... G03G 15/00; G03G 15/02; G03G 15/16

(52) U.S. Cl. ..... 399/159; 399/176; 399/313

(58) Field of Search ..... 399/159, 174, 399/175, 176, 279, 297, 303, 313

(56) References Cited

U.S. PATENT DOCUMENTS

| | | | | |
|---|---|---|---|---|
| 5,119,141 A | * | 6/1992 | Bhagat | 399/313 X |
| 5,146,280 A | * | 9/1992 | Kisu | 399/176 |
| 5,250,994 A | * | 10/1993 | Ito et al. | 399/303 X |
| 5,258,811 A | * | 11/1993 | Miyake et al. | 399/279 X |
| 5,357,325 A | * | 10/1994 | Kawaguchi | 399/313 |
| 5,515,154 A | * | 5/1996 | Hasegawa et al. | 399/303 |
| 5,572,305 A | * | 11/1996 | Hayashi et al. | 399/313 X |
| 6,173,137 B1 | * | 1/2001 | Zona | 399/313 X |
| 6,208,826 B1 | * | 3/2001 | Yoshinaga et al. | 399/313 X |
| 6,385,417 B1 | * | 5/2002 | Tanaka et al. | 399/159 X |
| 6,405,006 B1 | * | 6/2002 | Tabuchi | 399/176 X |

FOREIGN PATENT DOCUMENTS

| | | |
|---|---|---|
| JP | 2-165173 | 6/1990 |
| JP | 4-175779 | 6/1992 |
| JP | 8-63043 | 3/1996 |
| JP | 9-218549 | 8/1997 |
| JP | 2710996 | 10/1997 |
| JP | 11-93940 | 4/1999 |

* cited by examiner

*Primary Examiner*—Sandra L. Brase
(74) *Attorney, Agent, or Firm*—Birch, Stewart, Kolasch & Birch, LLP.

(57) ABSTRACT

A first control member is disposed in a drum shaft away from a photoconductive drum, and a second control member is disposed in a roller shaft away from a transfer roller. The first and second control members abut on each other at their circumferential surfaces. This helps reduce an amount of displacement resulting from an impact caused by insertion of a recording paper sheet in between the photoconductive drum and the transfer roller, and thereby reduce vibrations in the photoconductive drum. Consequently, a toner image formed on the photoconductive drum and an unfixed toner image transferred onto the recording paper sheet are not affected by vibrations, so that a high-quality image is obtained that is free from blurriness or irregularities.

8 Claims, 16 Drawing Sheets

IMAGE DEVICE WITH CONTROL MEMBERS FOR ROLLERS

BACKGROUND OF THE INVENTION

1. Field of the Invention

The present invention relates to an electrophotographic image forming apparatus such as a copying machine, a facsimile machine, or a printer.

2. Description of the Related Art

There is known an image forming apparatus as an apparatus in which a toner image formed on a photoconductive drum is transferred to a sheet of recording paper so as to form an image on the sheet of recording paper. Conventionally, an image forming apparatus capable of obtaining high quality printed image is desired.

FIG. 6A and FIG. 6B show part of an image forming apparatus 1 in accordance with the conventional technique. FIG. 6A is a cross sectional view and FIG. 6B shows a simplified model. As shown in FIG. 6A, a photoconductive drum 2 is composed of a hollow cylindrical photoconductive drum elementary pipe portion 43 and a pair of drum flanges 6 which cover openings at both ends of the photoreceptor drum elementary pipe portion 43. Further, a drum shaft 8, which penetrates the photoconductive drum 2 in the axial direction, is provided on the same shaft as that of the photoconductive drum 2. Then, the drum shaft 8 is rotatably supported by a pair of shaft bearings 41 provided at both ends of the drum shaft.

A transfer roller 3 has a cylindrical shape, and an axis A2 thereof is arranged in parallel with an axis A1 of the photoconductive drum 2. Further, a roller shaft 7, which penetrates the transfer roller 3 in the axial direction, is provided on the same shaft as that of the transfer roller 3, and is rotatably supported by a pair of shaft bearings 42 provided at both ends of the roller shaft. Further, the roller shaft 7 comes in contact with a pair of spring members 5 having elasticity in the axial direction, a pair of tracking rolls 4, which are a control means according to the invention, are provided. The roller shaft 7 is pressed against the drum shaft 8 with the spring members 5. The gap H is made between the photoconductive drum 2 and the transfer roller 3 at a proper value by allowing each tracking roll 4 to come in contact with the photoconductive drum 2. Such conventional image forming apparatus 1 is disclosed in Japanese Unexamined Patent Publication JP-A 9-218549 (1997).

Such an image forming apparatus 1 is configured to make the gap between a circumferential surface of the photoconductive drum and a circumferential surface of the transfer roller. Accordingly, the photoconductive drum and the transfer roller can move without friction, so that abrasion and peeling of the photoreceptive layer in the circumferential surface of the photoreceptor drum can be prevented. Consequently, the toner image can be finely transferred to the recording paper, thereby preventing fluctuation of image.

Further, in addition to the above mentioned image forming apparatus which is configured to keep the gap between a circumferential surface of the photoconductive drum and a circumferential surface of the transfer roller at a proper value by the controlling means such as a tracking roll, there is another image forming apparatus, which is configured so as to press the circumferential surface of the photoconductive drum and the circumferential surface of the transfer roller with a specific pressure by the controlling means. Such conventional technique is disclosed in Japanese Unexamined Patent Publication JP-A 2-165173 (1990).

According to the image forming apparatus, by bringing the circumferential surface of the photoconductive drum into contact with the circumferential surface of the transfer roller, and by pressing them at a steady specific pressure, there is no need to further increase the transfer electric field (or potential difference) which functions between the circumferential surface of the photoconductive drum and the circumferential surface of the transfer drum. Further, problems such that letters are missing in the middle part due to high pressure is not raised. Consequently, the toner image can be finely transferred to the recording paper.

The foregoing conventional technique has the following problems, in which the positional relationship between the outer circumference of an image carrier which supports a toner image, such as a photoconductive drum, a photoconductor belt, and an intermediate transfer, and the circumferential surface of the transfer roller which transfers the toner image on the image carrier to the recording paper, is controlled to be a predetermined positional relationship by spring members and the controlling means.

When inserting a sheet of recording paper between the surface of the image carrier and the surface of the transfer roller, the interval between the photoconductive drum and the transfer roller further increases in comparison with the case where sheets of recording paper are not housed in the space between the surface of the image carrier and the surface of the transfer roller. After discharging the recording paper from the space between the surface of image carrier and the surface of the transfer roller, the positional relationship is reset to its original position by the spring members. At the time, an impact caused by insertion and withdrawal of the recording paper, is transmitted to the image carrier. In particular, when inserting a recording paper having a certain thickness and unevenness, the impact is increased.

An impact is transmitted to the image carrier, thereby causing displacement of the image carrier in a short time and creating vibrations on the toner image supported on the image carrier and unfixed toner image which is transferred to the recording paper. Consequently, there is problems that blot and blur of image are generated due to vibrations and high quality image cannot be obtained. In a particular case where the image carrier and the transfer roller have a hollow, when an impact is transmitted to the outer circumference of the portion having a hollow inside, vibrations created by the image carrier is further increased.

Further, according to the copying machine, which is one example of the image forming apparatus, after fixing an image of a developing material such as a toner on the circumferential surface of the photoconductive drum, which is one example of the image carrier, the toner image is transferred to transfer materials such as a transfer sheet, thereby printing the image. At the time, in the periphery of the photoconductive drum, rotating bodies are provided, namely, a charging roller which applies static charges to the photoconductive drum, a developing roller which forms a toner image on the circumferential surface of the photoconductive drum, and a transfer roller which transfers the toner image by pressing against the circumference of the photoconductive drum. At this time, to obtain an image having a certain quality, these rotating bodies provided in the periphery are required to keep the interval between shafts or the interval between circumferential surfaces with regard to the photoconductive drum with high accuracy.

In response to the needs, the following technique is proposed in, for example, JP-A 2-165173 and Japanese Unexamined Patent Publication JP-A 8-63043 (1996). A guide portion is provided on the peripheral rotating body such as the transfer roller and the circumference or the rotation axis of the image carrier such as the photoconductive drum, and the guide portion comes in contact with the circumference of the image carrier or the peripheral rotating body, thereby keeping the interval between shafts of the image carrier and the peripheral rotating body and the interval between the circumferences to a proper value.

Further, according to the technique disclosed in Japanese Unexamined Patent Publication JP-A 4-175779 (1992), a ring-shaped spacer roller provided on the peripheral rotating body are brought into contact with support members of the image carrier, thereby the interval between shafts of the image carrier and the peripheral rotating body and the interval between the circumferences can be kept to a proper value.

In JP-A 2-165173 and JP-A 8-63043, the following technique is disclosed. The guide portion or the like comes in contact with the opposing material while rotating around the periphery of each rotating shaft in accordance with the rotation of the image carrier and the peripheral rotating body. In JP-A 4-175779, the spacer roller are brought in contact with a supporting portion of the image carrier while rotating in accordance with the rotation of the support member of the image carrier and the peripheral rotating body.

Then, in the periphery of the image carrier, fine particles made of the developing material such as a toner, and the transfer material such as a transfer sheet, are suspended in general. In such environment, there is a problem in accordance with the technique disclosed in JP-A 2-165173 and JP-A 8-63043. Because the guide portion comes in contact with the opposing material while rotating, the particles bite the contact surface, thereby creating vibrations on the image carrier and the peripheral rotating body, or causing the abrasion on the contact surface. Consequently, it becomes difficult to keep the interval between the image carrier and the peripheral rotating body to a proper value, in some cases. Further, according to JP-A 4-175779, since the support member of the image carrier to be contacted with the spacer roller is generally charged, it can relieve adhesion of the toner or the like, however, it is impossible to solve the problem of the abrasion. Moreover, the guide portion disclosed in JP-A 2-165173 and JP-A 8-63043, and the spacer roller disclosed in JP-A 4-175779, the whole circumferences become the contact surface. Therefore, there is necessity to process the whole circumferences of the guide portion and the spacer in high accuracy, so that the cost of processing rises.

Further, according to the copying machine, which is one example of the image forming apparatus, to transfer a toner image formed on the circumference of the photoconductive drum (an example of an image carrier), to a paper or the like (an example of a transfer material), the paper is guided to the predetermined transfer position by a paper guide (an example of a guide member) in close proximity to the transfer roller (an example of a transfer member). The paper or the like is pressed against part of the circumferential surface of rotating photoreceptor drum by the transfer roller, thereby transferring the toner image. At the time, to keep a certain image quality of the transferring image transferred to the paper or the like, the transfer roller and the paper guide should be arranged with respect to the photoreceptor drum with high accuracy.

Then, when a paper jam is caused between the transfer roller and the photoreceptor drum or the paper guide, or when a stain is found on the circumferential surface of the transfer roller, it is necessary to remove the jammed paper or perform maintenance such as cleaning of the circumferential surface of the transfer roller. Because of this, the transfer roller and the paper guide, which is formed in close proximity thereto, should be supported to be separated. Also, it is desirable to perform the separation easily. To meet the needs, the following technique is disclosed in Japanese Unexamined Patent Publication JP-A 11-93940 (1999). As a method of supporting the transfer roller so as to facilitate a work top mount and demount, mounting and demounting of the transfer roller can be easily carried out by providing a collar, a handle part, and the like provided with a small-diameter part in a non-circular shape in cross section, at the end portion of the rotation axis of the transfer roller, and rotating the small-diameter part in the direction capable of mounting and demounting through operation of the handle part.

According to JP-A 11-93940, however, when mounting and demounting the transfer roller at the time of performing maintenance, the paper guide should be mounted and demounted with a screw and the like, so that there is a problem that it takes much time to perform maintenance operation. Moreover, there arises another problem that the extent of screwing causes displacement of the positional relationship between the transfer roller and the paper guide.

According to the copying machine and the like, which is one example of the image forming apparatus, to transfer a toner image formed on the circumferential surface of the photoconductive drum (an example of an image carrier), to a paper or the like (an example of a transfer material), the paper is guided to the predetermined transfer position by a paper guide (an example of a guide member) in close proximity to the transfer roller (an example of a transfer member), The paper is pressed against part of the circumferential surface of rotating photoconductive drum by the transfer roller, thereby transferring the toner image. Further, the paper which is stuck to the photoconductive drum due to static electricity, is peeled off by removing static electricity from the transferred paper, with a means for removing static. At the time, to keep a certain image quality of the transferring image transferred to the paper, the interval between the transfer roller or the paper guide and the means for removing static should be arranged with respect to the photoreceptor drum with high accuracy. In addition to this, the intense of pressing the transfer member against the photoconductive drum should be kept consistently.

To meet the needs, the following technique is disclosed in Japanese Examined Patent Publication JP-B2 2710996. By supporting the paper guide with a shaft of the transfer roller, the paper guide is arranged with respect to the transfer roller with high accuracy.

In general, the transfer member such as a transfer roller is pressed against the image carrier with a spring or the like so as to keep consistent intense of pressing against the image carrier. Accordingly, when the surface of the transfer member deteriorates with time, the position of the rotation axis of the transfer member with respect to the image carrier is deviated. At the time, since the paper guide is supported with the shaft of the transfer roller according to JP-B2 2710996, there is a problem that the position of the paper guide with respect to the image carrier is also deviated. Further, when performing maintenance on the transfer roller at paper jam, it is necessary to remove the paper guide from the shaft of the transfer roller. However, the function of facilitating the removal is not indicated, so that there is a problem that maintenance operation is difficult.

Moreover, the function for positioning of the means for removing static electricity is not particularly disclosed in JP-B2 2710996. It can be considered to support the means for removing static electricity with a shaft of the transfer roller, as in the case of supporting the paper guide disclosed in JP-B2 2710996, however, there is a problem that the position is deviated when the surface of the transfer roller deteriorates with time.

It is an object of the invention to provide an image forming apparatus in which fine transfer can be carried out without transmitting vibrations to an image carrier and a recording paper even if an impact is caused when inserting and discharging the recording paper.

It is an object of the invention to provide an image forming apparatus at low cost, in which proper positioning can be carried out without causing vibrations due to a bite of suspended particles such as a toner or the abrasion of the members for positioning.

It is an object of the invention to provide an image forming apparatus in which positioning of the transfer member and the guide member which guides a transfer material to the transfer position, can be carried out with respect to the image carrier with high accuracy, and the guide members, which are arranged in close proximity to the transfer member, can be easily separated so as to perform maintenance on the transfer member.

It is an object of the invention to provide an image forming apparatus which facilitates the positioning of the transfer member, the guide member, the means for removing static electricity, and the like, with respect to the image carrier with high accuracy.

SUMMARY OF THE INVENTION

The invention provides an image forming apparatus comprising:

an image carrier for carrying a toner image; and a transfer roller which is loaded with a force that tends to move the transfer roller toward the image carrier, the transfer roller being arranged in a predetermined positional relation to the image carrier by control means, wherein the control means is disposed between an axis of the transfer roller and an axis of the image carrier so as to be located outwardly away from an axial end portion of the image carrier.

The invention provides an image forming apparatus comprising:

an image carrier, rotatably supported, for carrying a toner image;

a peripheral rotary body involved in image formation, which is rotatably supported in a periphery of the image carrier; and control means for controlling displacement of the peripheral rotary body in a direction proximate to the image carrier so as to maintain a predetermined positional relationship between the image carrier and the peripheral rotary body, the control means being so configured that an acting point of impacting force, which is generated in between the image carrier and the peripheral rotary body at a time of image formation, is located on an axis of the image carrier between a position of an axial end portion of the image carrier and a position nearby in which the image carrier is supported.

According to the invention, the image carrier and the peripheral rotary body, for example a transfer roller, are arranged in a predetermined positional relationship by the control means. The control means is arranged axially outwardly relative to the image carrier. This arrangement helps reduce the amount of displacement of the image carrier resulting from impacting force caused by insertion and ejection of a recording paper sheet.

According to the invention, when impacting force is generated due to the passage of the recording paper sheet, the amount of displacement of the image carrier, as well as vibrations developed in the image carrier per se, can be reduced. This makes it possible to prevent a blurred image from occurring at the time of insertion and ejection of a recording paper sheet, thereby obtaining high-quality images.

Besides, in the image forming apparatus embodying the invention, there is no need to increase an axial dimension of the image carrier for the sake of abutment of the control means, and therefore the image carrier can be made small in the axial dimension. This contributes to reduction in cost associated with the image carrier which is consumable yet expensive.

In the invention, it is preferable that the control means is made of a material having shock absorbency.

According to the invention, since the control means is made of a shock-absorbing material, an impact caused by insertion and ejection of a recording paper sheet can be absorbed by the control means, there by alleviating the impact on the image carrier and the recording paper sheet during image transfer process.

Further, according to the invention, the control means is capable of absorbing an impact. Thus, the impact on the image carrier and the recording paper sheet during image transfer process can be further alleviated, thereby attaining more satisfactory image quality.

In the invention, it is preferable that the control means includes a first control member loosely fitted to a shaft of the image carrier and a second control member loosely fitted to a shaft of the peripheral rotary body, the first and second control means abutting against each other.

According to the invention, the first and second control members are loosely fitted to the shafts of the image carrier and the peripheral rotary body, for example, a transfer roller, respectively. In this arrangement, even if the image carrier and the transfer roller are rotated, the first and second control members can be constantly kept at rest in an abutting state without rotating. Consequently, the control members are each inhibited from rotating concurrently with the image carrier and the transfer roller, thereby preventing the wearing away of the abutment surfaces of the control members. Moreover, since the abutment surfaces of the control members are made less prone to adhesion of foreign matters such as toner, a predetermined positional relationship can be established between the image carrier and the transfer roller with high accuracy.

Further, according to the invention, the wearing away of the abutment surfaces of the first and second control members, as well as adhesion of foreign matters, can be successfully prevented, and thereby a certain gap can be secured between the image carrier and the transfer roller with accuracy. This makes it possible to impart steady contact pressure force to a recording paper sheet during image transfer process, thus allowing the toner image to be transferred onto the recording paper sheet without causing unevenness.

In the invention, it is preferable that the control means is arranged outwardly away from the axial end portion of the peripheral rotary body.

According to the invention, the control means is arranged away from the end portion of the peripheral rotary body, for example, a transfer roller. This arrangement helps reduce the amount of displacement of the transfer roller caused by impacting force resulting from insertion and ejection of a recording paper sheet.

Further, according to the invention, since the control means is arranged away from the end portion of the transfer roller, the amount of displacement of the transfer roller caused by impacting force can be reduced. This further decreases the possibility of a blurred image being created during insertion and ejection of a recording paper sheet.

In the invention, it is preferable that the image forming apparatus further comprises oscillation control means for controlling oscillation of each of the first and second control members.

According to the invention, the first and second control members are inhibited from oscillation and kept in an abutting state. Thus, it never occurs that the fine particles are bitten into the abutment portions or that the abutment portions rub and wear. Moreover, by not processing the entire circumferential surfaces of the first and second control members but only their abutment portions with high accuracy, the processing operation can be carried out at relatively low cost.

In the invention, it is preferable that the oscillation control means is so configured as to inhibit rotation of the first and second control members.

According to the invention, the first and second control members can be disposed so as not to rotate in synchronism with the rotary shaft.

In the invention, it is preferable that the abutment portion of the first control member, which abuts against the second control member, is so configured as to protrude outwardly relative to the other non-abutting portions.

According to the invention, the first control member can be made lighter in weight and occupies less space than in a case of adopting a disc shape.

In the invention, it is preferable that a helical gear is additionally provided as driving means for rotatably driving at least one of the image carrier and the peripheral rotary body.

According to the invention, vibrations resulting from a bite of suspended particles such as toner, as well as abrasion of the positioning members, can be successfully prevented. This allows highly accurate positioning of the rotatably-supported image carrier and the peripheral rotary body involved in image formation rotatably arranged in the periphery of the image carrier, such as a charge body or transfer member.

The invention provides an image forming apparatus comprising:

an image carrier for carrying a toner image;

image carrier supporting means for supporting the image carrier in such a way that the image carrier is rotatable about a first rotary shaft which is arranged substantially horizontally;

a transfer member for transferring the toner image carried on the image carrier onto a transfer material;

transfer member supporting means for supporting the transfer member in such a way that the transfer member is rotatable about a second rotary shaft which is arranged substantially parallel to the first rotary shaft; and a guide member, arranged in close proximity to the transfer member, for guiding the transfer material to a transfer position in the transfer member, the guide member being supported by the transfer member supporting means.

According to the invention, since the guide member is supported by the transfer member supporting means for supporting the transfer member, positioning of the guide member with respect to the transfer member can be achieved with high accuracy. This allows the transfer material to be guided to the transfer position with improved accuracy.

In the invention, it is preferable that the transfer member supporting means and the guide member are each designed to be positioned with respect to the image carrier supporting means by abutting against the image carrier supporting means.

According to the invention, the transfer member supporting means and the guide member can be positioned with respect to the image carrier supporting means with high accuracy. This allows the transfer member and the guide member to be positioned with respect to the image carrier with high accuracy, so that the quality of the transferred image is maintained at a predetermined level.

In the invention, it is preferable that the guide member is supported by the transfer member supporting means so as to be oscillatable within a predetermined range of oscillation, and that, when the transfer member supporting means is moved away from the image carrier supporting means, the guide member oscillates so as to be located in a position distant from the transfer member.

According to the invention, prior to performing maintenance on a path through which the transfer material passes, the transfer member supporting means and the image carrier supporting means are moved away from each other. This allows the guide member to move away from the transfer member, thereby facilitating the maintenance of the transfer position.

According to the invention, the transfer member and the guide member for guiding the transfer material to the transfer position can be positioned with respect to the image carrier with high accuracy. This makes it possible to maintain the quality of the image transferred onto the transfer material at a predetermined level. Moreover, the guide member can be easily moved away from the transfer roller arranged in close proximity thereto, thereby facilitating maintenance such as cleaning of the transfer roller.

The invention provides an image forming apparatus comprising:

an image carrier for carrying a toner image;

image carrier supporting means for supporting the image carrier in such a way that the image carrier is rotatable about a first rotary shaft which is arranged substantially horizontally;

a transfer member for transferring the toner image carried on the image carrier onto a transfer material;

transfer member supporting means for supporting the transfer member in such away that the transfer member is rotatable about a second rotary shaft which is arranged substantially parallel to the first rotary shaft;

a cover member, arranged so as to be freely movable close to and away from the image carrier supporting means, for supporting the transfer member supporting means in such a way that the transfer member supporting means is kept in a floating state in a substantially horizontal direction;

a guide member, arranged in close proximity to the transfer member, for guiding the transfer material to a transfer position in the transfer member;

a transfer member supporting means urging mechanism, disposed in the cover member, for resiliently urging the transfer member supporting means toward the image carrier supporting means; and first positioning means, disposed in part of the transfer member supporting means, for positioning the transfer member supporting means with respect to the image carrier supporting means by abutting against the image carrier supporting means.

According to the invention, so long as the transfer member supporting means and the image carrier supporting means can be prevented from moving away from each other by the transfer member supporting means urging mechanism, the transfer member supporting means can be positioned with respect to the image carrier supporting means with high accuracy. As a result, the transfer member is positioned with respect to the image carrier with high accuracy.

In the invention, it is preferable that the transfer member supporting means is additionally provided with a transfer member urging mechanism for resiliently urging the transfer member toward the image carrier.

According to the invention, even if, for example, the surface of the transfer member deteriorates with time, by the transfer member urging mechanism, the contact pressure force of the transfer member with respect to the image carrier can be kept constant.

In the invention, it is preferable that a first urging pressure, which is exerted by the transfer member supporting means urging mechanism in a direction of the image carrier supporting means, is set to be greater than a second urging pressure exerted by the transfer member urging mechanism in the same direction.

According to the invention, the transfer member supporting means is prevented from moving away from the image carrier supporting means by a reaction force exerted by the transfer member urging mechanism. At this time, in order to keep these supporting means closer to each other under a state where vibrations take place in the image forming apparatus, the first urging pressure should preferably be set to be 1.5 times or above greater than the second urging pressure.

In the invention, it is preferable that there are additionally provided guide member supporting means for supporting the guide member on the transfer member supporting means; and second positioning means, disposed in part of the guide member, for positioning the guide member with respect to the image carrier supporting means by abutting against the image carrier supporting means.

According to the invention, the guide member is supported by the transfer member supporting means which is arranged in a predetermined position with respect to the image carrier supporting means. Thus, similarly, the guide member is positioned with respect to the image carrier with a predetermined distance secured therebetween.

In the invention, it is preferable that an urging position in the transfer member supporting means urging mechanism is located in between the first positioning means and the second positioning means.

According to the invention, it never occurs that the urging pressure of the transfer member supporting means urging mechanism is lopsidedly exerted on one of the first and second positioning means, thereby making the positioning state more stable.

In the invention, it is preferable that there is provided charge removal means for removing charges remaining on the transfer material after the transfer process, and the charge removal means is supported by the transfer member supporting means.

According to the invention, the charge removal means is supported by the transfer member supporting means which is arranged in a predetermined position with respect to the image carrier supporting means. Thus, similarly, the charge removal means can be positioned with respect to the image carrier with a predetermined distance secured therebetween.

According to the invention, the transfer member, the guide member, the charge removal means, and the like can be easily positioned with respect to the image carrier with high accuracy, thereby keeping the quality of the image transferred onto the transfer material at a predetermined level.

BRIEF DESCRIPTION OF THE DRAWINGS

Other and further objects, features, and advantages of the invention will be more explicit from the following detailed description taken with reference to the drawings wherein:

FIG. 5A is a cross sectional view and FIG. 5B is a simplified model;

FIG. 6A is a cross sectional view and FIG. 6B is a simplified model;

DETAILED DESCRIPTION OF THE PREFERRED EMBODIMENTS

Figure 1:
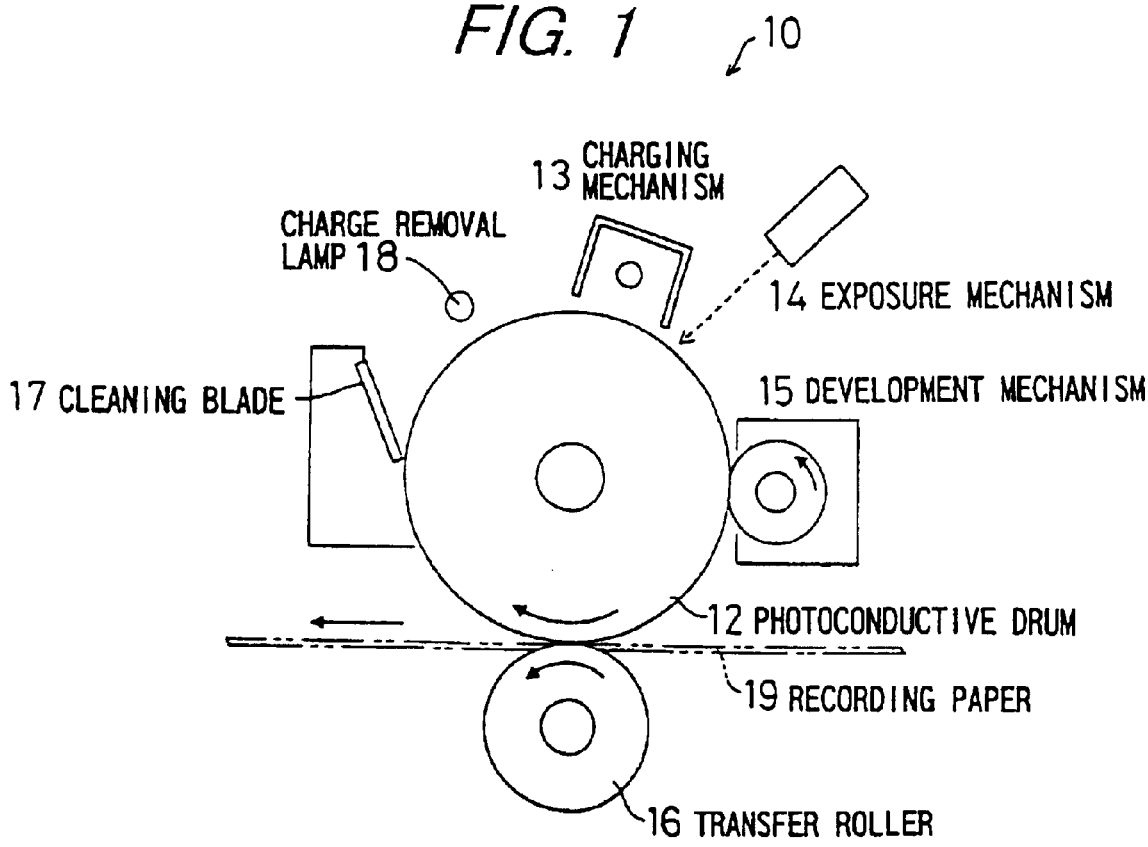
FIG. 1 is a cross sectional view showing a principal configuration of an image forming apparatus 10 of a first embodiment according to the invention.

Now referring to the drawings, preferred embodiments of the invention are described below.

Now, embodiments of the present invention will be described and will be offered for understanding of the present invention with reference to the accompanying drawings. Incidentally, the ensuing embodiments are mere practicable examples of the present invention, and they are not of characters restricting the technical scope of the present invention.

FIG. 1 is a sectional view showing the principal construction of an image forming apparatus 10 in this embodiment. The image forming apparatus 10 is an apparatus, such as copying machine or printer, in which an image is formed on recording paper by electrophotography, and in which a mechanism for forming the image on the recording paper is disposed around a photoconductive drum 12 being an image carrier. Arrayed successively from the upstream side of the photoconductive drum 12 in the rotating direction thereof are a charging mechanism 13 which charges the surface of the photoconductive drum 12 uniformly, an exposure mechanism 14 which irradiates the photoconductive drum surface with light for forming an electrostatic latent image, a development mechanism 15 which forms a toner image by supplying toner to the electrostatic latent image formed on the photoconductive drum surface, a transfer roller 16 which is a peripheral rotary member for transferring the toner image formed on the photoconductive drum surface onto the recording paper 19 being a recording medium, a cleaning blade 17 which cleans the photoconductive drum surface, and a charge removal lamp 18 which removes residual charges on the photoconductive drum surface.

In the image forming apparatus 10, image formation proceeds in such a way that the surface of the photoconductive drum 12 is first charged uniformly by the charging mechanism 13, that the charged photoconductive drum surface is irradiated with a laser beam by the exposure mechanism 14 so as to form an electrostatic latent image, that the electrostatic latent image is supplied with the toner by the development mechanism 15 so as to form a toner image, that the toner image is transferred onto the recording paper which is sent in between the transfer roller 16 and the photoconductive drum 12, and that the recording paper is heated by a thermal fixation mechanism, not shown, so as to fix the toner image onto the recording paper.

The toner which remains on the photoconductive drum surface after the image transfer is removed by the cleaning blade 17, and charges which similarly remain on the photoconductive drum surface are removed by the charge removal lamp 18, whereby the image forming apparatus 10 gets ready for the next image formation.

Figure 2:
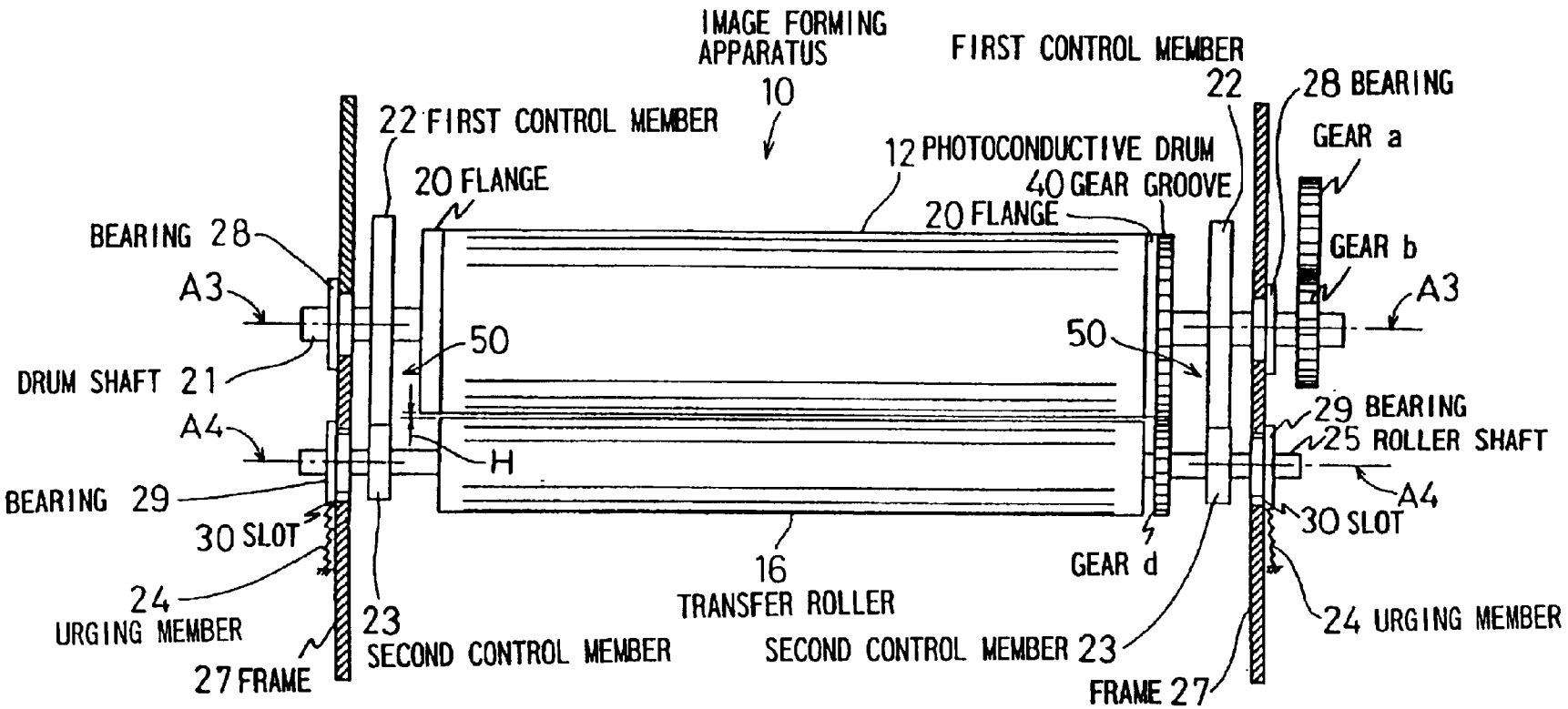
FIG. 2 is a cross sectional view showing the vicinity of a transfer roller of the image forming apparatus 10.
Figure 5A:
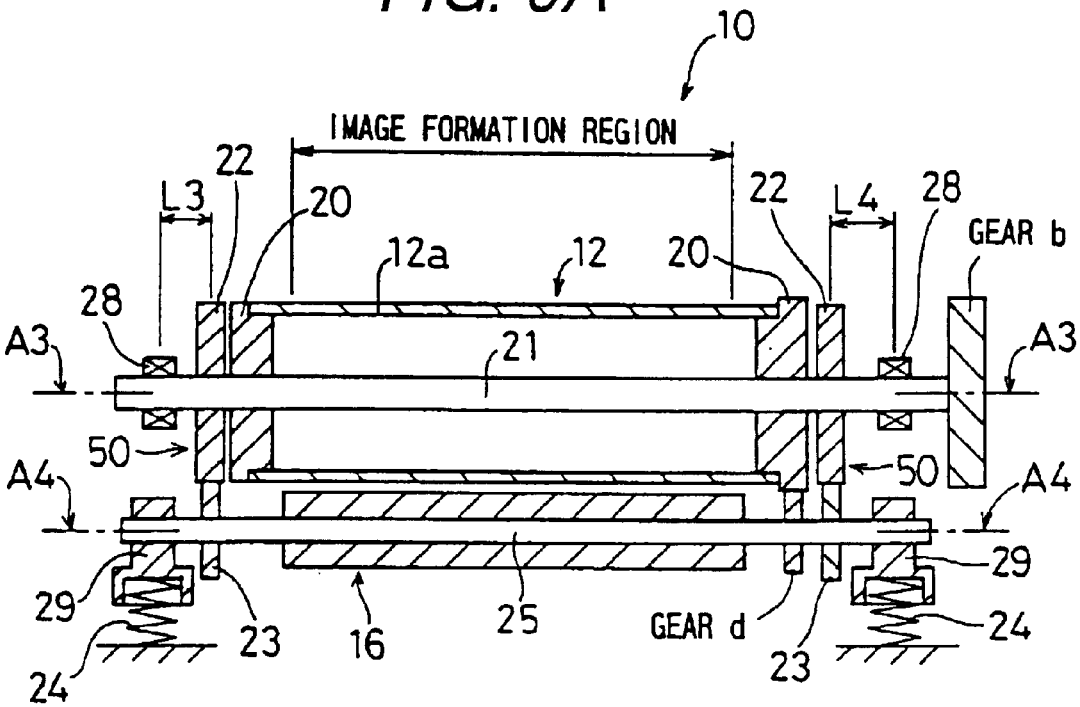
FIGS. 5A–5B show part of the image forming apparatus 10 in accordance with the first embodiment of the invention.

FIG. 2 shows the vicinity of the transfer roller 16 of the image forming apparatus 10, and is a sectional view seen from a side on which the recording paper is inserted. As shown in FIG. 2 and FIG. 5A to be referred to later, the image forming apparatus 10 includes the photoconductive drum 12, flanges 20, the transfer roller 16, first control members 22, second control members 23 and urging members 24.

Referring to FIG. 5A to be described later, the photoconductive drum 12 is formed of a photoconductive drum elementary pipe 12*a* which is in the shape of a hollow cylinder, and the pair of drum flanges 20 which cover the open parts of the photoconductive drum elementary pipe 12*a* at both the ends thereof. Besides, a drum shaft 21 which penetrates through the photoconductive drum 12 in the axial direction thereof is formed so as to be coaxial with this photoconductive drum 12, and the drum shaft 21 is rotatably supported by a pair of drum side bearings 28 which are disposed at both the end parts of this drum shaft 21.

The transfer roller 16 is formed in the shape of a column, and its axis A4 is arranged in parallel with the axis A3 of the photoconductive drum 12. Besides, a roller shaft 25 which penetrates through the transfer roller 16 in the axial direction thereof is formed so as to be coaxial with this transfer roller 16. The roller shaft 25 is rotatably supported by a pair of roller side bearings 29 which are disposed at both the end parts of this roller shaft 25. As shown in FIG. 2, the roller side bearings 29 are fitted in corresponding slots 30 which are provided in the frame 27 of the image forming apparatus 10. The roller side bearings 29 are displaceable toward the drum shaft 21 owing to the slots 30, whereby the roller shaft 25 which these roller side bearings 29 support is supported so as to be capable of coming near to and away from the drum shaft 21. In this embodiment, accordingly, the transfer roller 16 is arranged under the photoconductive drum 12 and is supported so as to be capable of moving up and down.

Further, a gear b is fixed to one end part of the drum shaft 21, and it meshes with a gear a to which a turning force is transmitted from a rotation transmission mechanism not shown. Thus, the turning force from the rotation transmission mechanism is transmitted to the photoconductive drum 12 through the gear a, gear b and drum shaft 21. Besides, gear grooves 40 are formed in the peripheral surface of one flange 20 mounted on the photoconductive drum 12, that is, the flange 20 on a side on which the gear b is formed.

A gear d is fixed to one end part of the roller shaft 25. The gear d meshes with the gear grooves 40 formed in the above flange 20. Thus, the rotation of the photoconductive drum 12 is transmitted to the transfer roller 16. Accordingly, the transfer roller 16 can be rotated in synchronism with the photoconductive drum 12 so as to hold the inserted recording paper between it and this drum 12 and to eject the recording paper.

The pair of bearings 29 on the roller shaft side are respectively furnished with the urging members 24. The urging members 24 have elasticity, and they are made of, for example, springs. Thus, the urging members 24 press the transfer roller 16 toward the photoconductive drum 12.

Figure 3:
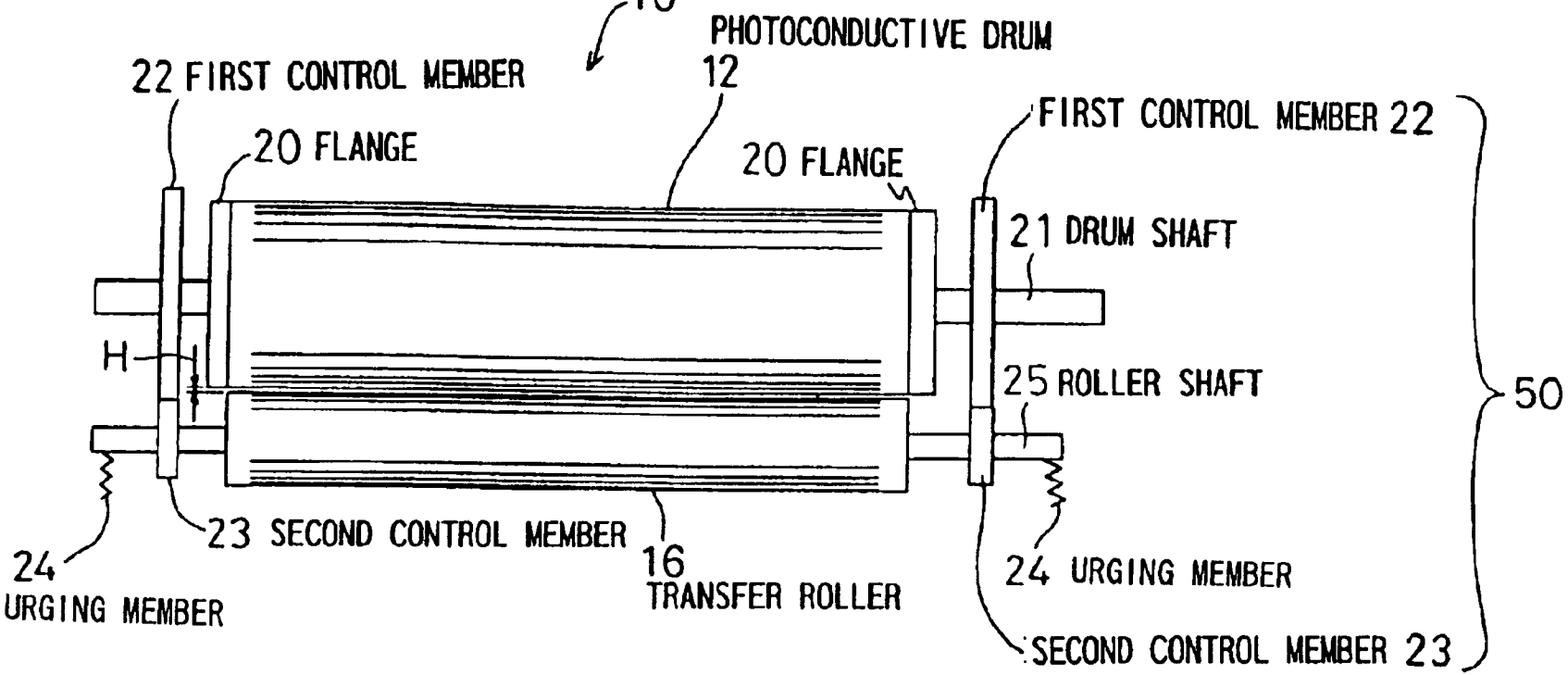
FIG. 3 is a front view showing part of the image forming apparatus shown in FIG. 2.

FIG. 3 is a front view showing part of the image forming apparatus 10 in FIG. 2. The first control members 22 and second control members 23 which constitute control means 50 are formed in the shape of discs, and such control members in one pair are respectively disposed on both the sides of each of the photoconductive drum 12 and transfer roller 16. The roller shaft 25 is urged toward the drum shaft 21 by the urging members 24 until the first control members 22 and the second control members 23 abut against each other, whereby a predetermined gap H is defined between the photoconductive drum 12 and the transfer roller 16. The predetermined gap H is set to be less than the thickness of the recording paper. In this way, the first and second control members 22, 23 regulate the displacement of the transfer roller 16 in the direction of coming near to the photoconductive drum 12.

The first control members 22 are loosely fitted at positions spaced from the photoconductive drum 12 in a state where they are rotatable with respect to the drum shaft 21. More specifically, each of the first control members 22 is arranged on the drum shaft 21 between the position of the axial end part of the photoconductive drum 12 and the position of the drum side bearing 28 nearby. Likewise, the second control members 23 are loosely fitted at positions spaced from the transfer roller 16 in a state where they are rotatable with respect to the roller shaft 25. More specifically, each of the second control members 23 is arranged on the roller shaft 25 between the position of the axial end part of the transfer roller 16 and the position of the roller side bearing 29 nearby. Besides, the first control members 22 and the second control members 23 have shock absorption means, and they are formed of an elastic, shock-absorbing material such as resin or hard rubber.

Figure 4A:
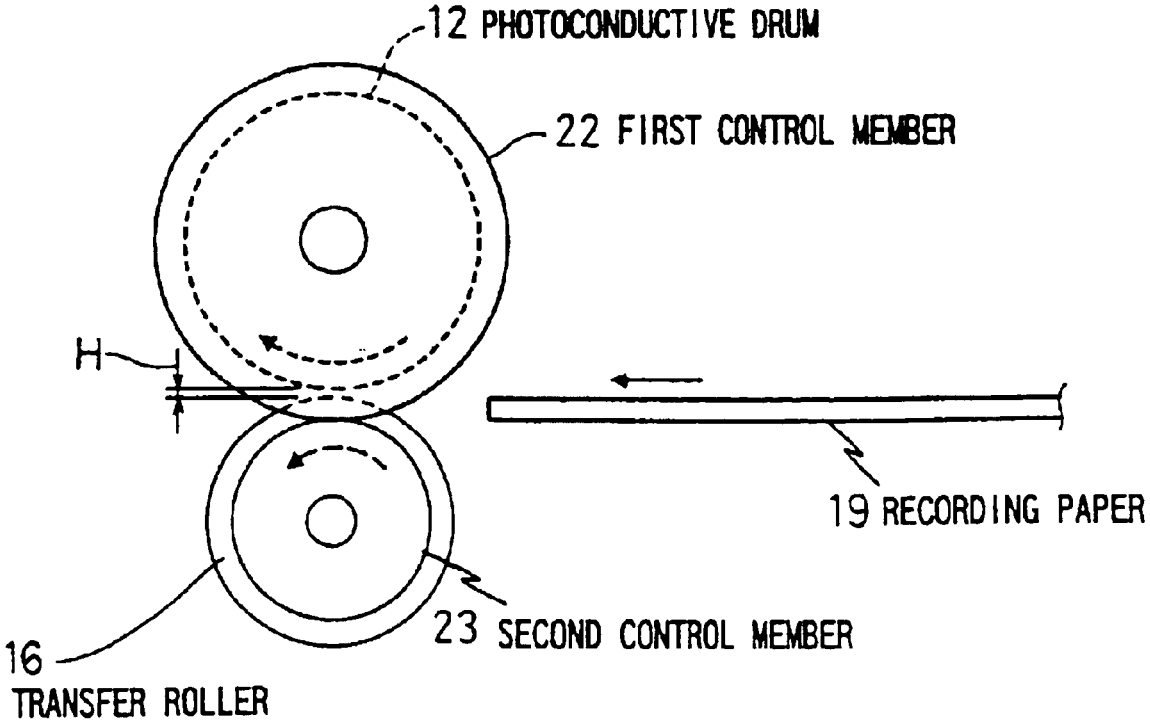
FIGS. 4A–4B are side views of FIG. 3.
Figure 4B:
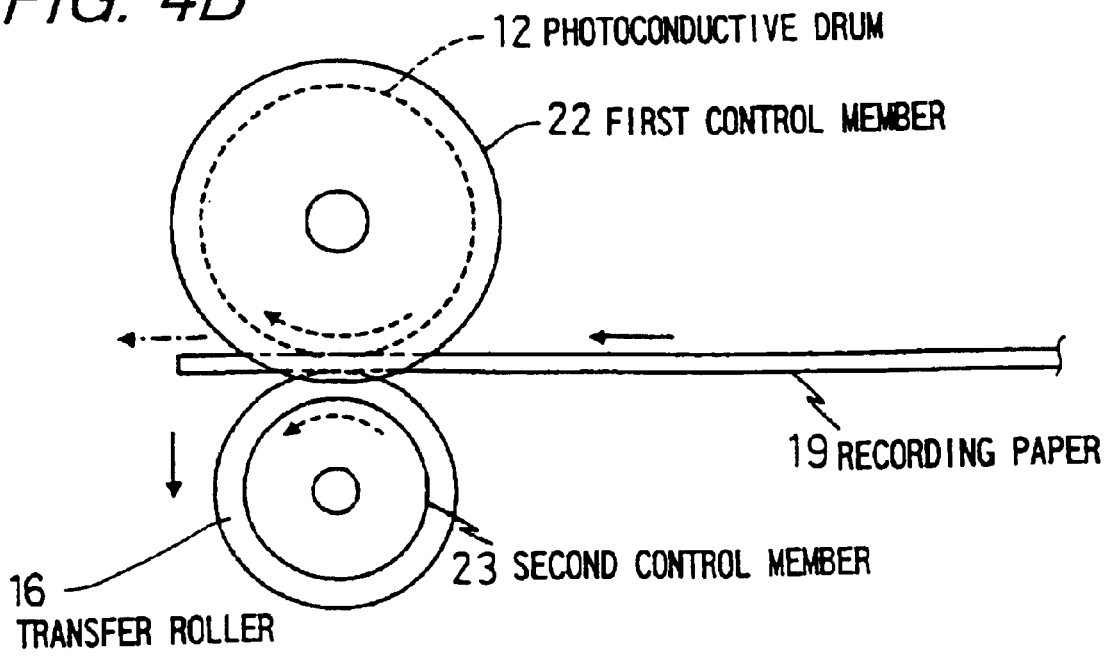

FIGS. 4A and 4B are side views corresponding to FIG. 3. FIG. 4A shows a state before the recording paper 19 is inserted, while FIG. 4B shows a state where the recording paper 19 has been inserted. The recording paper 19 is conveyed toward the gap H between the photoconductive drum 12 and the transfer roller 16 as shown in FIG. 4A, and it is inserted between the photoconductive drum 12 and the transfer roller 16 as shown in FIG. 4B. On this occasion, since the thickness of the recording paper 19 is greater than the gap H between the photoconductive drum 12 and the transfer roller 16, the transfer roller 16 is brought away from the photoconductive drum 12, and the distance between the photoconductive drum 12 and the transfer roller 16 increases, so that the first control members 22 and the second control members 23 come away from each other. The transfer roller 16 is pressed by the urging members 24 so as to come near to the photoconductive drum 12, and the recording paper 19 passes between the photoconductive drum 12 and the transfer roller 16 against the pressing forces of the urging members 24. When the recording paper 19 has been ejected, the first control members 22 and the second control members 23 are brought into abutment again by the spring forces of the urging members 24, and the distance between the photoconductive drum 12 and the transfer roller 16 is restored to the predetermined gap size H.

Herein, impulses appear at the insertion and ejection of the recording paper 19. Since, however, the first control members 22 and the second control members 23 are mounted at the positions respectively spaced from the photoconductive drum 12 and the transfer roller 16, moments acting due to the forces of the impulses can be lessened to mitigate the deflections of the photoconductive drum 12 and the transfer roller 16. This will be elucidated with reference to FIGS. 5A, 5B, 6A and 6B.

Figure 5B:
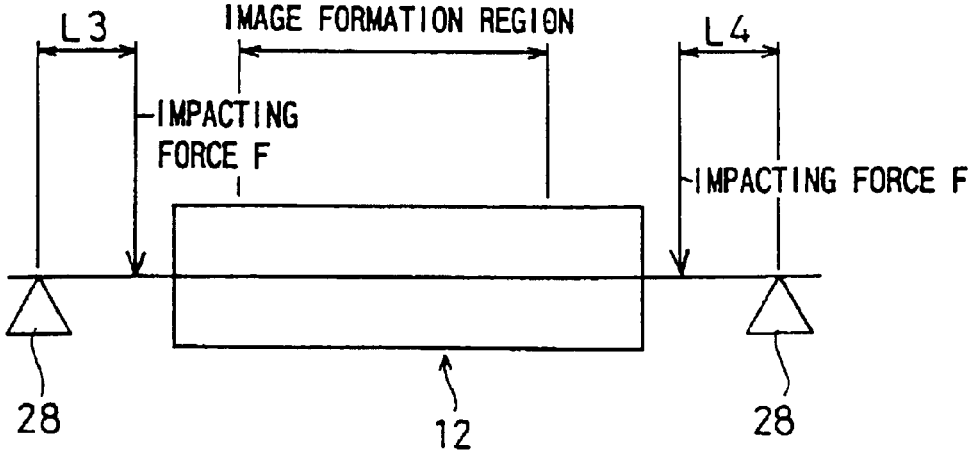

FIGS. 5A and 5B show part of the image forming apparatus 10 in the embodiment of the present invention, and FIG. 5A is a sectional view, while FIG. 5B is a simplified model diagram. On the other hand, FIGS. 6A and 6B show part of an image forming apparatus 1 in the prior art, and FIG. 6A is a sectional view, while FIG. 6B is a simplified model diagram.

Figure 6A:
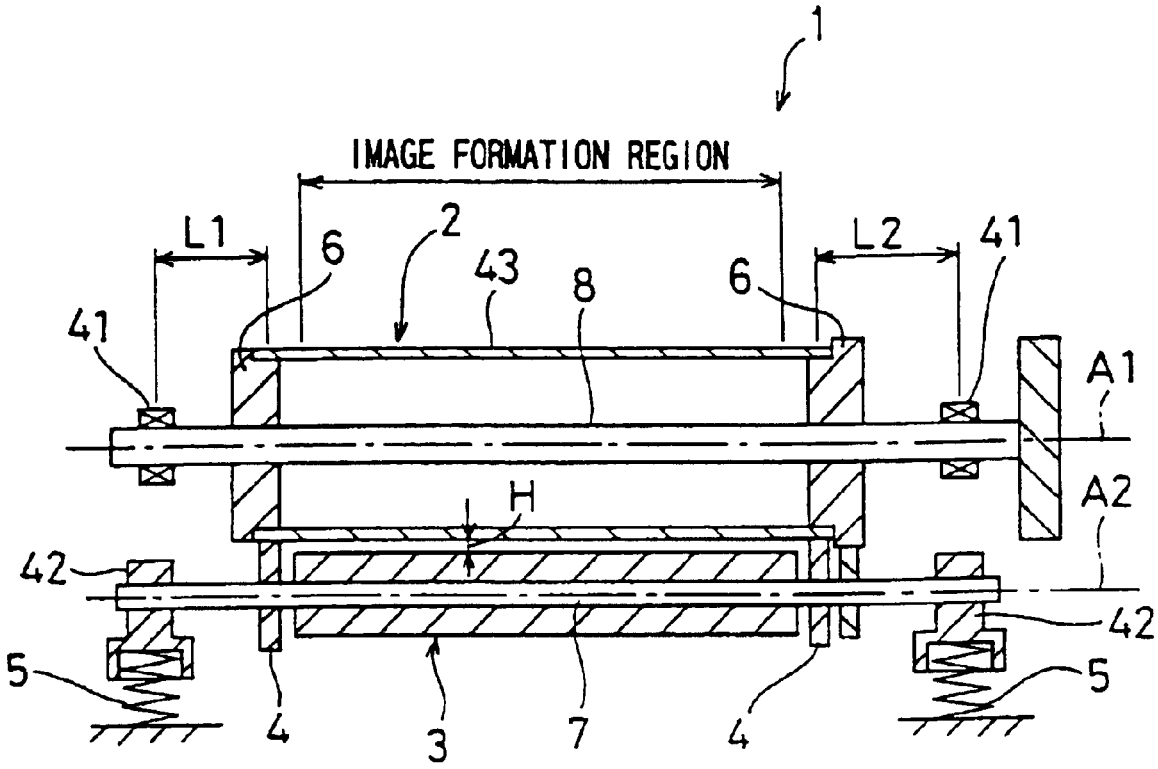
FIG. 6A PRIOR ART
FIGS. 6A–6B show part of a conventional image forming apparatus 1.

As shown in FIG. 5A and FIG. 6A, in order to compare the prior-art apparatus 1 and the apparatus 10 of the invention, they are assumed to be the same in, for example, the dimensions of photoconductive drums 2, 12, the positions of bearings 41, 28, the characteristics of urging means 5, 24, the dimensions of drum shafts 8, 21 and the materials of various members, except the positions of control means 4, 50 arranged round the axes of the photoconductive drums 2, 12 being image carriers. In the prior-art apparatus 1, the control means 4 abut against the outer periphery of the photoconductive drum 2, and they are respectively disposed at predetermined lengths L1, L2 from the drum side bearings 41. In contrast, in the apparatus 10 of the invention, the control means 50 are spaced from the photoconductive drum 12, and they are respectively disposed at predetermined lengths L3, L4 from the drum side bearings 28. As the lengths between the drum side bearings 41, 28 and the control means 4, 50, accordingly, the lengths L3, L4 in the apparatus 10 of the invention are less than the lengths L1, L2 in the prior-art apparatus 1.

The magnitudes of the impulsive forces which arise in inserting and ejecting the recording paper, depend upon how much the transfer roller is displaced from the axis of the photoconductive drum. Accordingly, in a case where the thicknesses of recording sheets of paper are equal, the image forming apparatuses 1, 10 in the prior art and of the invention undergo equal impulsive force magnitudes. Since, however, the impulsive forces appear at the positions of the control means for regulating the relative position between the photoconductive drum and the transfer roller, the acting positions of the impulsive forces differ between in the prior art and in the invention. More specifically, in the prior-art apparatus 1, the acting points of the impulsive forces are located at both the axial end parts of the photoconductive drum 2. In the apparatus 10 of the present invention, the acting points of the impulsive forces are located on the drum shaft 21 between the positions of the axial end parts of the photoconductive drum 12 and the positions of the corresponding drum side bearings 28 nearby.

Figure 6B:
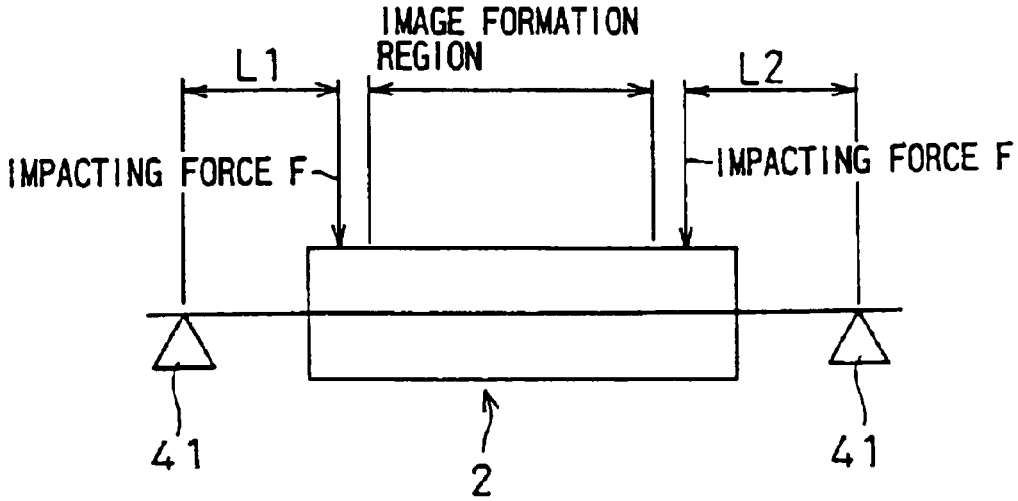
FIG. 6B PRIOR ART

As shown in FIG. 5B and FIG. 6B, accordingly, moments around the bearings 28, 41 based on the impulsive forces F become less in the invention than in the prior art for the reason that the lengths L3, L4 between the bearings 28 and the control means 50 in the case of the invention are less than the lengths L1, L2 between the bearings 41 and the control means 4 in the case of the prior art. Consequently, the deflections of the drum shafts attributed to the impulsive forces F become less in the invention than in the prior art, and the displacement magnitudes and vibrations of the surfaces of the photoconductive drums bearing toner images become less in the invention than in the prior art.

As described above, according to the invention, when the impulse forces have acted due to the passage of the recording paper, the displacement magnitudes and vibrations of the image carrier can be relieved, and the toner image on the image carrier can be favorably transferred onto the recording paper.

Further, the first and second control members are formed of the shock absorbing material, so that the impulsive forces and the vibrations ascribable thereto are absorbed. The vibrations to be imparted to the photoconductive drum 12 and the recording paper 19 are relived in this way, whereby the toner image formed on the photoconductive drum 12, and the toner image transferred onto the recording paper and not fixed yet are not vibrated, a picture is prevented from blurring or oscillating, and a good picture can be formed.

Moreover, the first control members 22 and the second control members 23 are loosely fitted on the drum shaft 21 and the roller shaft 25, respectively, so that even when the drum shaft 21 and the roller shaft 25 have been rotated, the first control members 22 and the second control members 23 can be at rest in an abutting state without rotating. Accordingly, the first control members 22 and the second control members 23 are not rotated together with the photoconductive drum 12 and the transfer roller 16, and the abutment surfaces of the first control members 22 and second control members 23 are prevented from wearing off. Besides, a foreign matter such as the toner does not adhere onto the abutment surfaces, and the exact constant gap H can be defined between the photoconductive drum 12 and the transfer roller 16.

The above embodiment merely exemplifies the invention, and the construction can be altered within the scope of the invention. By way of example, in the embodiment, the control means are employed so as to define the predetermined gap H between the photoconductive drum being the image carrier and the transfer roller. However, the invention is not restricted only to the aspect, but it shall cover also, for example, an image forming apparatus in which control means regulate the image carrier and the transfer roller so that the transfer roller may be held in pressed contact with the image carrier under a predetermined pressure.

Besides, in this embodiment, the photoconductive drum and the transfer roller are regulated into the predetermined positional relationship by causing the first control members and the second control members to abut against each other, but the predetermined positional relationship may well be established by employing one sort of control members. By way of example, the photoconductive drum and the transfer roller may well be regulated into the predetermined positional relationship by causing the first control members and the shaft of the transfer roller to abut against each other, or by causing the second control members and the shaft of the image carrier to abut against each other.

Further, at least either the first control members or the second control members need not be disposed directly on the shaft, and they may be arranged between the respective axes A3 and A4 of the photoconductive drum 12 and transfer roller 16. By way of example, it is also allowed to dispose other members coaxial with the axis A3 and to dispose at least either the first or the second control members between the axes A3 and A4 through the other members. Moreover, the first and second control members need not always be disc-shaped, but they may well be in any other shapes.

Still further, the image carrier is exemplified as the photoconductive drum in the foregoing, but it may alternatively be a photosensitive belt or an intermediate transfer member. In case of the photosensitive belt, the control means are disposed between the axis of a shaft opposing to the transfer roller, among a plurality of shafts for rotating the photosensitive belt tightly, and the axis of the transfer roller.

Figure 7:
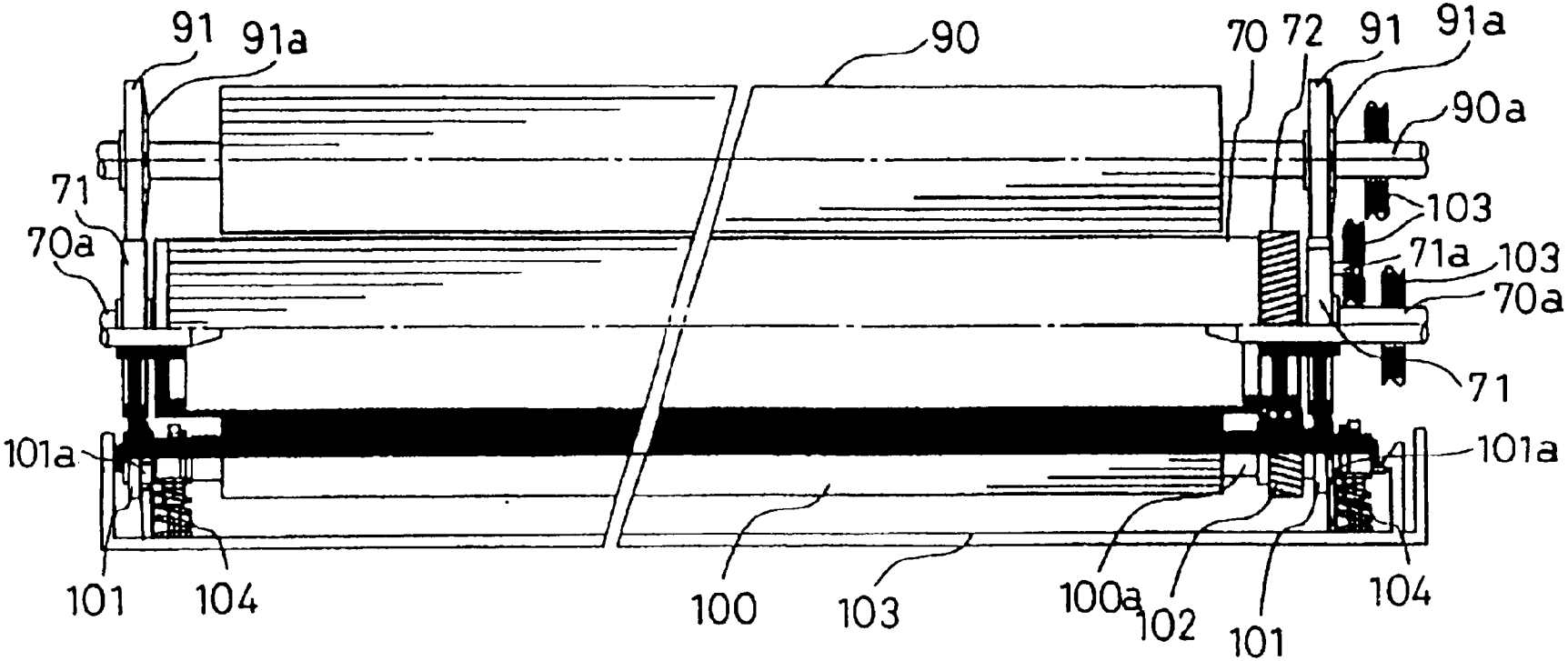
FIG. 7 is a plan view showing an image forming apparatus of a second embodiment of the invention in which part of a principal part thereof is cross-sectionally shown.
Figure 8:
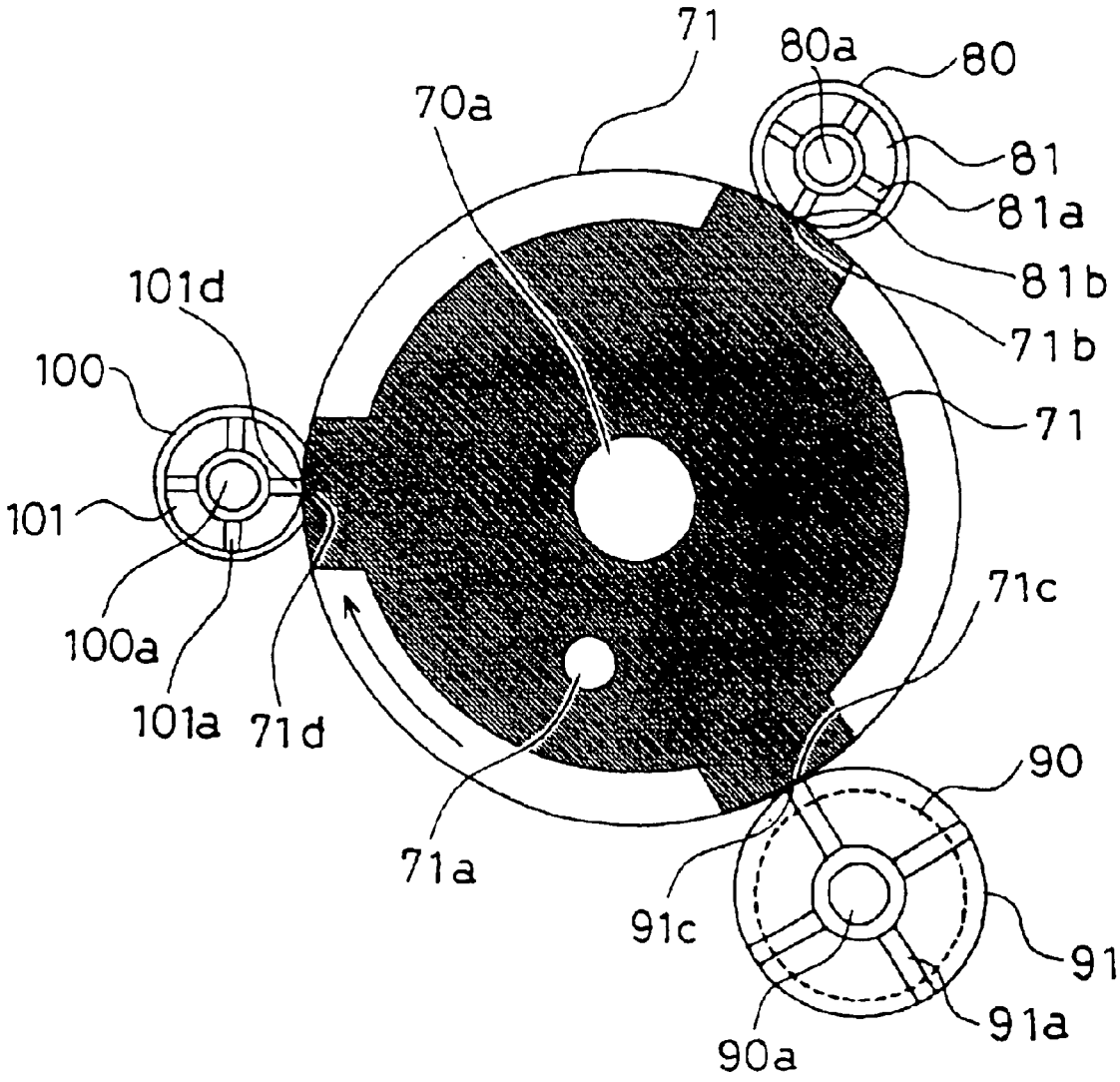
FIG. 8 is a schematic front view showing the principal part of the image forming apparatus of the second embodiment of the invention.
Figure 9:
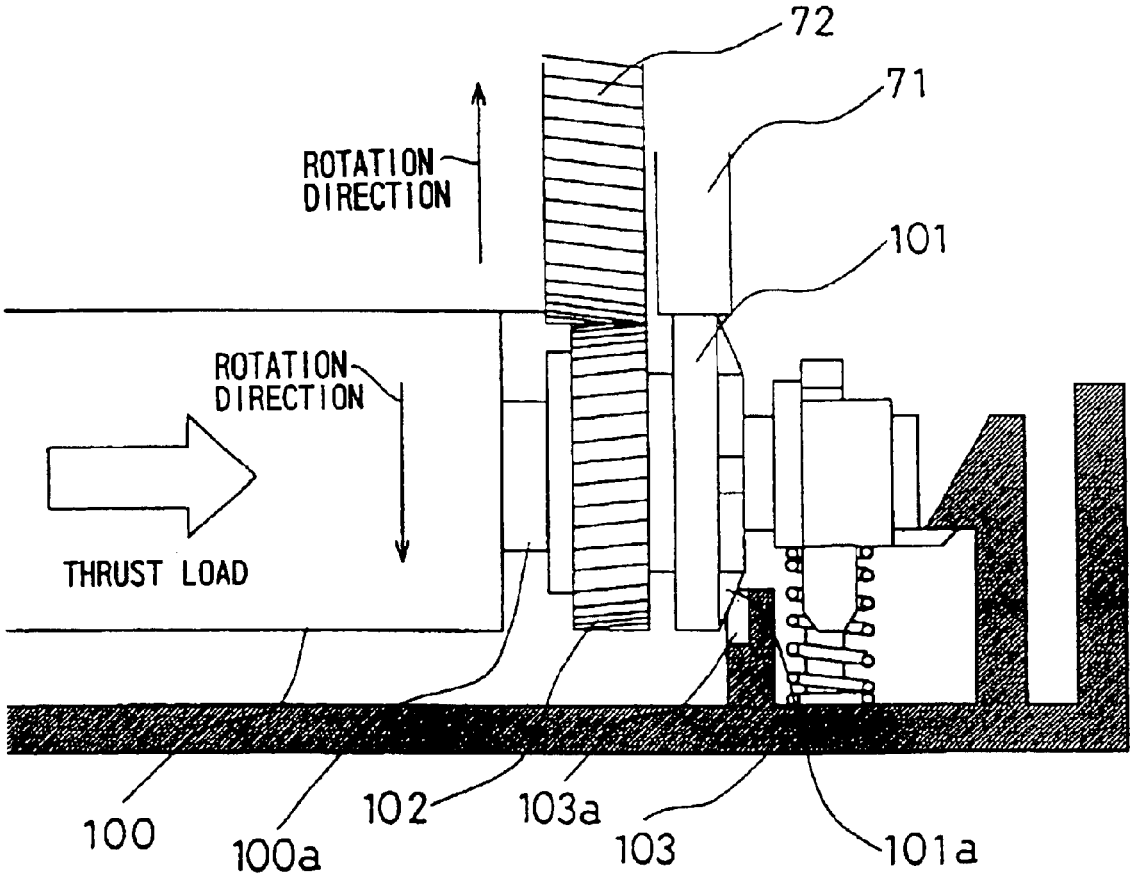
FIG. 9 is a schematic plan view showing the image forming apparatus of the second embodiment in which part of the principal part is enlargedly shown.
Figure 10:
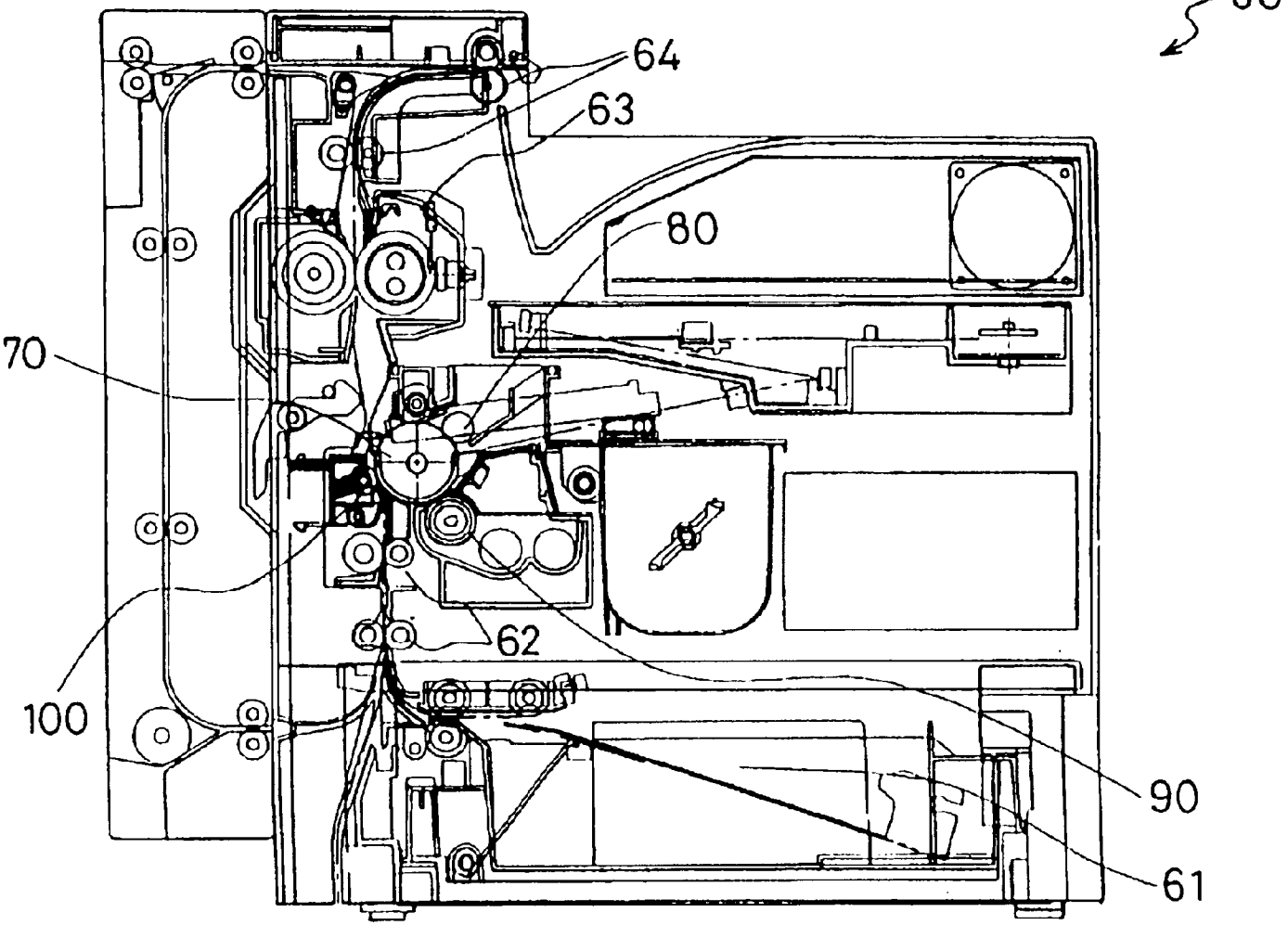
FIG. 10 is a cross sectional view showing the image forming apparatus of the second embodiment of the invention.

Here, FIG. 7 is a partially-sectional plan view of the principal portions of an image forming apparatus 60 according to the second embodiment of the invention, FIG. 8 is a schematic front view of the principal portions of the image forming apparatus 60 according to the second embodiment of the invention, FIG. 9 is a partially-enlarged schematic plan view of the principal portions of the image forming apparatus 60 according to the second embodiment of the invention, and FIG. 10 is a sectional view of the image forming apparatus 60 according to the second embodiment of the invention.

The image forming apparatus 60 is a copying machine which is an example of an image forming apparatus embodying the invention.

First, the arrangement of the principal portions, etc. in the image forming apparatus 60 will be described with reference to FIG. 10. FIG. 10 is a front sectional view of the apparatus 60. A photoconductive drum 70 (being an example of an image carrier) which is one of the principal portions is arranged near the left side of the apparatus 60 substantially centrally in the vertical direction thereof, and it is surrounded with a charging roller 80, a development roller 90 and a transfer roller 100 (being examples of peripheral rotary members, respectively) Transfer paper or the like for forming a picture thereon is fed from a paper supply unit 61 located at the lower part of the apparatus 60, to the touching parts of the peripheral surfaces of the photoconductive drum 70 and the transfer roller 100, by feed rolls 62. The transfer paper or the like onto which a toner image on the photoconductive drum 70 has been transferred by the transfer roller 100, has its toner image fixed by a fixation device 63 located at the upper part of the apparatus 60 and is ejected onto the top surface of the apparatus 60 by paper ejection rolls 64.

Next, the principal portions of the image forming apparatus 60 will be described with reference to FIGS. 7, 8 and 9. As shown in FIG. 7, the photoconductive drum 70 is a columnar member of hollow structure, and it is rotatably supported by two drum shafts 70*a* which are, in turn, supported by a supporting member 103. Besides, the development roller 90 and the transfer roller 100 which are arranged around the photoconductive drum 70 are respectively supported by the supporting members 103 through rotary shafts 90*a* and 100*a*. Photosensitive collars 71 (being an example of first control members), and development collars 91 and transfer collars 101 (being examples of second control members, respectively) are snugly supported at both the end parts of the corresponding rotary shafts 70*a*, 90*a* and 100*a* of the photoconductive drum 70, development roller 90*a* and transfer roller 100, respectively. The collars 71, 91 and 101 are respectively provided with openings which are substantially equal in diameter to the corresponding rotary shafts 70*a*, 90*a* and 100*a*, and the rotary shafts 70*a*, 90*a* and 100*a* are respectively supported in states where they are inserted through the corresponding openings. Regarding the charging roller 80 not shown in FIG. 7, charging collars 81 (being an example of the second control members) (refer to FIG. 8) are supported likewise to the development collars 91 and the transfer collars 101. The photosensitive collars 71 are pressed articles of metal, molded articles of resin, or the likes, and the charging collars 81, development collars 91 and transfer collars 101 are molded articles of resin, or the likes.

One of the photosensitive collars 71 is provided with a pin 71*a* (being an example of oscillation control means) protruding in parallel with the corresponding drum shaft 70*a*, and it is so constructed that the pin 71*a* engages part of the supporting member 103. Besides, the charging collars 81, development collars 91 and transfer collars 101 are respectively provided with ribs 81*a*, 91*a* and 101*a* (being examples of the oscillation control means, respectively) rising in parallel with the corresponding rotary shafts 80*a*, 90*a* and 100*a*, and they are so constructed that the ribs 81*a*, 91*a* and 101*a* engage parts of the supporting member 103. Shown in FIG. 9 is a state where the rib 101*a* with which the transfer collar 101 is provided engages the part 103*a* of the supporting member 103.

Owing to the engagements of the pin 71*a* and the ribs 81*a*, 91*a* and 101*a*, the collars 71, 81, 91 and 101 are respectively held so as not to rotate even when the photoconductive drum 70, charging roller 80, development roller 90 and transfer roller 100 are rotated.

As shown in FIG. 8, the charging collars 81, development collars 91, and transfer collars 101 abut against the photosensitive collars 71 at abutment parts 71*b* and 81*b*, 71*c* and 91*c*, and 71*d* and 101*d*, respectively. Thus, the interaxial distances of the respective rotary shafts 80*a*, 90*a* and 100*a* of the charging roller 80, development roller 90 and transfer roller 100 with respect to the drum shafts 70*a* are held constant. The collars 71, 81 have their dimensions from the corresponding rotary shafts 70*a*, 90*a* to the abutment parts 71*c*, 91*c* machined within predetermined errors in order that the gap between the peripheral surfaces of the development roller 90 and photoconductive drum 70 may become a value appropriate for development, for example, about 0.5 mm. Besides, the transfer roller 100 has its peripheral surface made of a conductive elastic material such as urethane rubber, while the charging roller 80 has its peripheral surface made of a brush of conductive fibers of, for example, rayon, the conductive elastic material, or the like. Further, the rotary shafts 100*a*, 80*a* of the respective rollers 100, 80 are pressed toward the drum shafts 70*a* by springs 104, etc.

Owing to the construction as stated above, the transfer collars 101 and charging collars 81 abut against the corresponding photosensitive collars 71, so that the respective interaxial distances are held constant and that the peripheral surfaces of the transfer roller 100 and charging roller 80 are held in a predetermined pressed contact state. Besides, since the collars 71, 81 and 101 have their outside diameters machined within predetermined errors, the precisions of the interaxial distances are kept high.

In this manner, the collars 71, 81, 91 and 101 which hold constant the interaxial distances of the charging roller 80, development roller 90 and transfer roller 100 with respect to the photoconductive drum 70 are held in the state where they a but at the abutment parts 71*b*, 71*c*, 71*d*, 81*b*, 91*c* and 101*d* without rotating. Therefore, toner or any other powder of paper pieces or the likes is not bitten into the abutment parts 71*b*, 71*c*, 71*d*, 81*b*, 91*c* and 101*d*, and the abutment parts 71*b*, 71*c*, 71*d*, 81*b*, 91*c* and 101*d* do not rub and wear, either. Further, the collars 71, 81, 91 and 101 may have only their dimensions from the corresponding rotary shafts 70*a*, 80*a*, 90*a* and 100*a* to the abutment parts 71*b*, 71*c*, 71*d*, 81*b*, 91*c* and 101*d* machined at high precisions, so that they can be fabricated at comparatively low cost.

Further, the photosensitive collar 71 is in a wasteless shape in which the abutment parts 71*b*, 71*c* and 71*d* thereof jut out more than the other non-abutting parts, so that it can be made lighter in weight and smaller in space than in case of a disc shape. By way of example, in a case where the photoconductive drum 70 and the peripheral devices, such as the charging roller 80, acting thereon are unitarily supported by the supporting member 103 so as to construct a process unit, the process unit can be compacted in such a way that reinforcement parts for reinforcing the process unit are formed in the recesses defined between the respectively adjacent abutment parts 71*b*, 71*c* and 71*d* of the photosensitive collar 71.

Besides, as shown in FIG. 7, helical gears 72, 102 for smoothly transmitting to the transfer roller 100 the turning force of the photoconductive drum 70 rotated by a driver not shown are respectively disposed on one end part of one of the drum shafts 70*a* and one end part of the rotary shaft 100*a* of the transfer roller 100, whereby the transfer roller 100 is smoothly driven to rotate.

Here, as shown in FIG. 9, a thrust load ascribable to the helical gears 72, 102 acts on the rotary shaft 100*a* of the transfer roller 100 in a direction toward one of the transfer collars 101, and the transfer collar 101 is about to rotate following the helical gear 102 on account of the friction of its contact surface with the helical gear 102. However, the rib 101*a* with which the transfer collar 101 is provided comes into engagement with the part 103*a* of the support member 103, and the rotation of the transfer collar 101 is checked.

While, in the image forming apparatus 60, the photosensitive collar 71 is so configured that the abutment parts 71*b*, 71*c* and 71*d* jut out more than the other parts thereof, it may alternatively be disc-shaped or take any other shape.

While, in the image forming apparatus 60, a helical gear is employed as means for transmitting a turning driving force to the transfer roller 100, a rubber belt or the like may be employed instead.

While the image forming apparatus 60 is embodied as an example of copying machines, an image forming apparatus to which the invention is applicable may include a laser printer, a facsimile machine, or the like.

Figure 11:
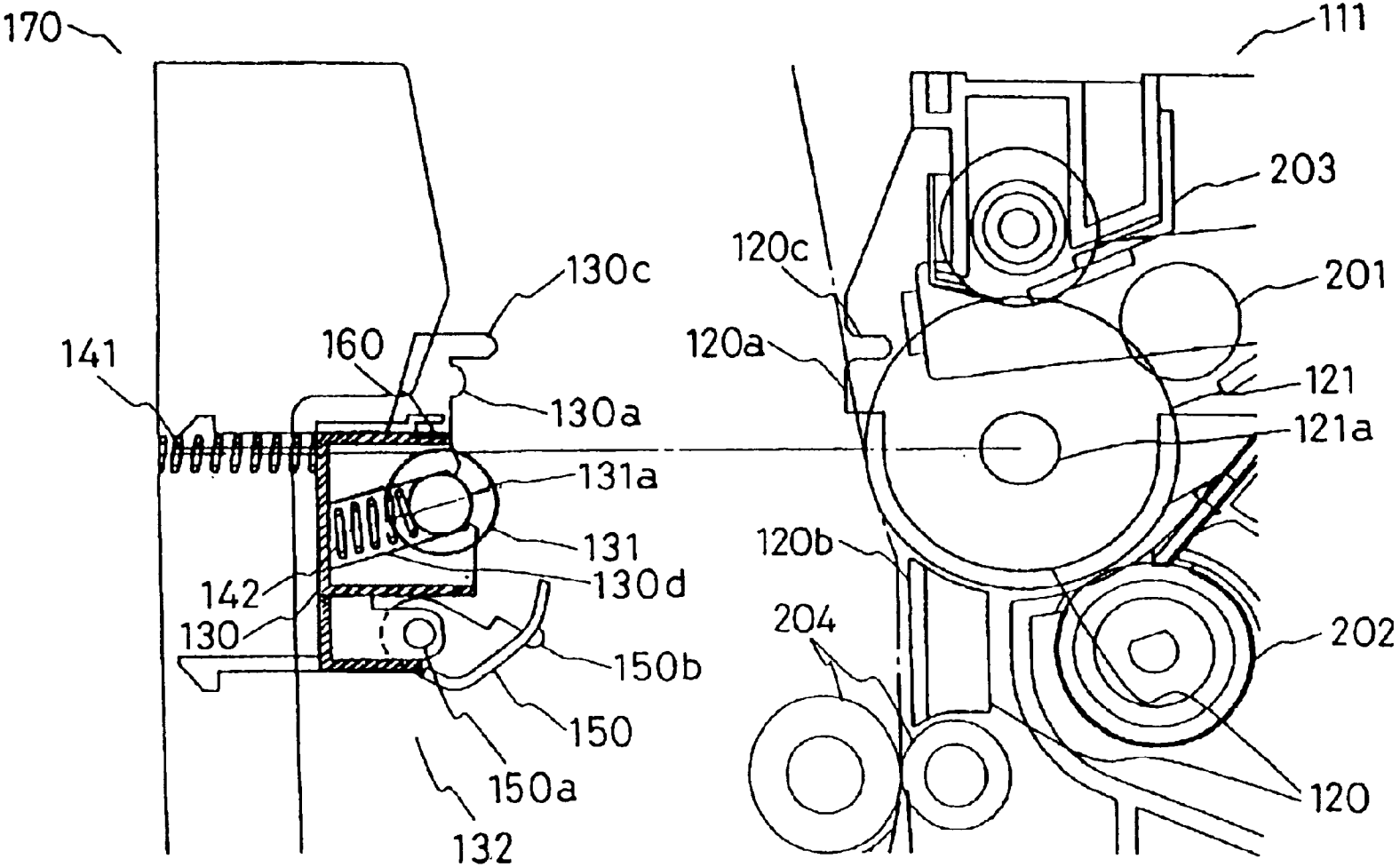
FIG. 11 is a cross sectional view showing a principal part of an image forming apparatus of a third embodiment of the invention in a state that a cover portion is opened.
Figure 12:
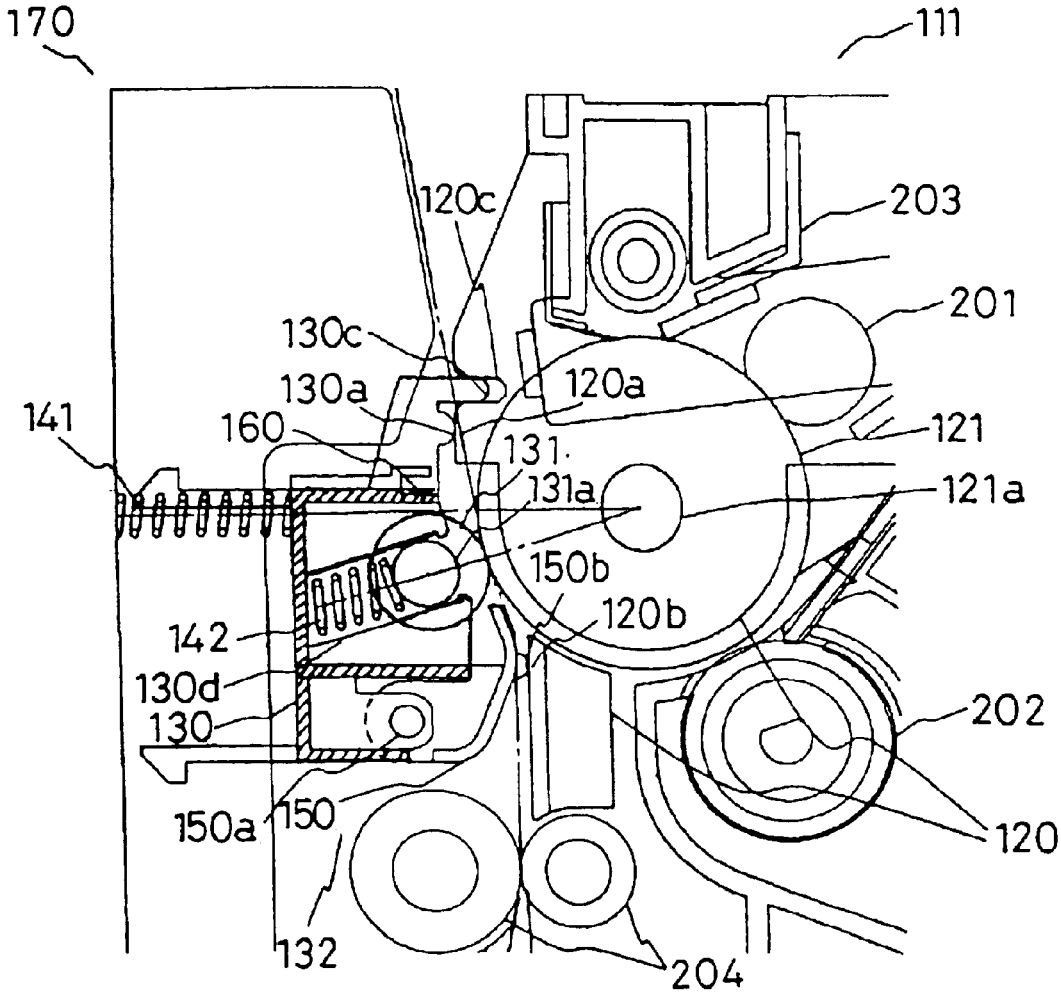
FIG. 12 is a cross sectional view showing the principal part of the image forming apparatus of the third embodiment in a state that a cover portion is closed.
Figure 13:
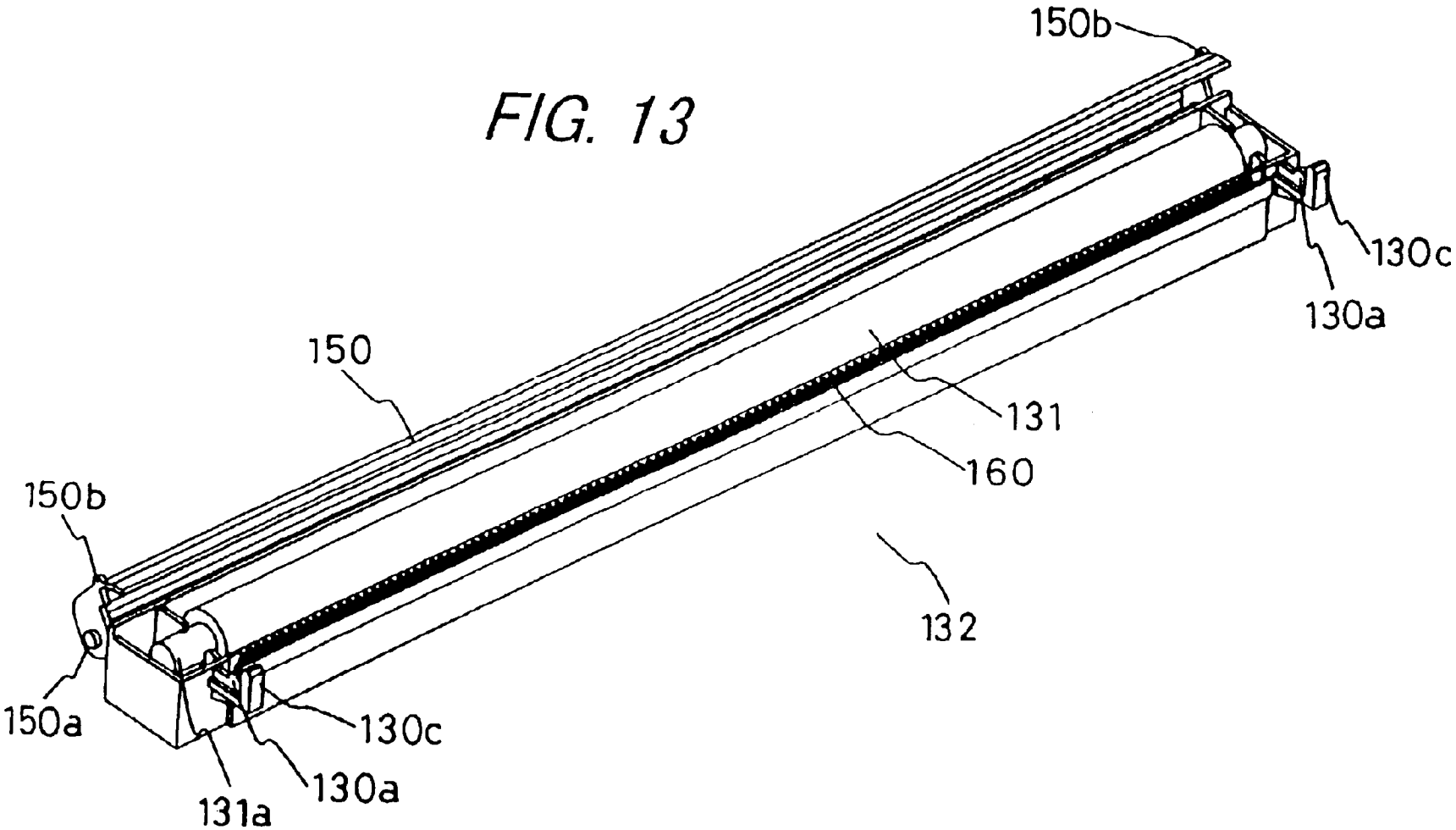
FIG. 13 is a perspective view showing a transfer device of the image forming apparatus of the third embodiment in a state that a paper guide is opened.
Figure 14:
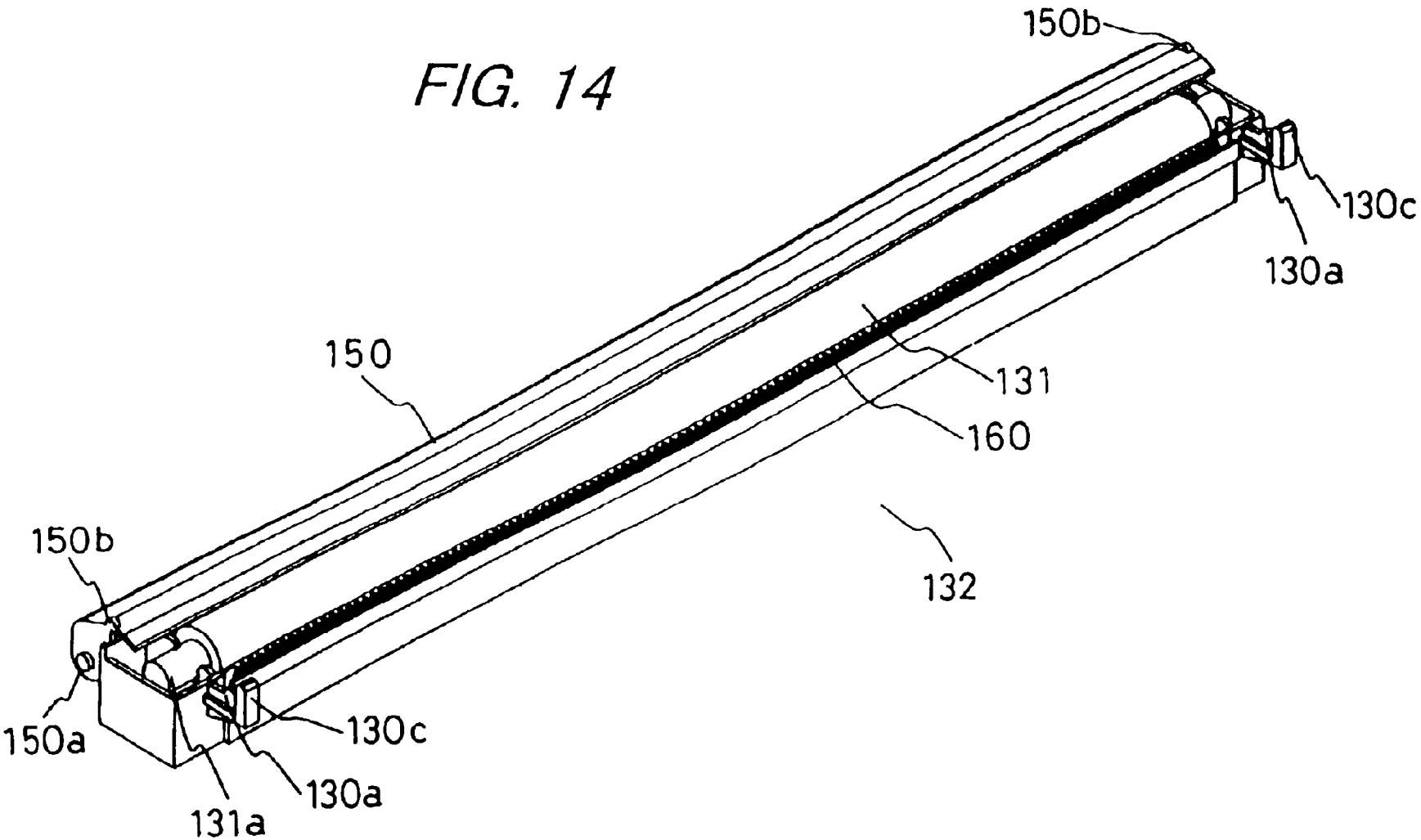
FIG. 14 is a perspective view showing the transfer device of the image forming apparatus of the third embodiment in a state that a paper guide is closed.
Figure 15:
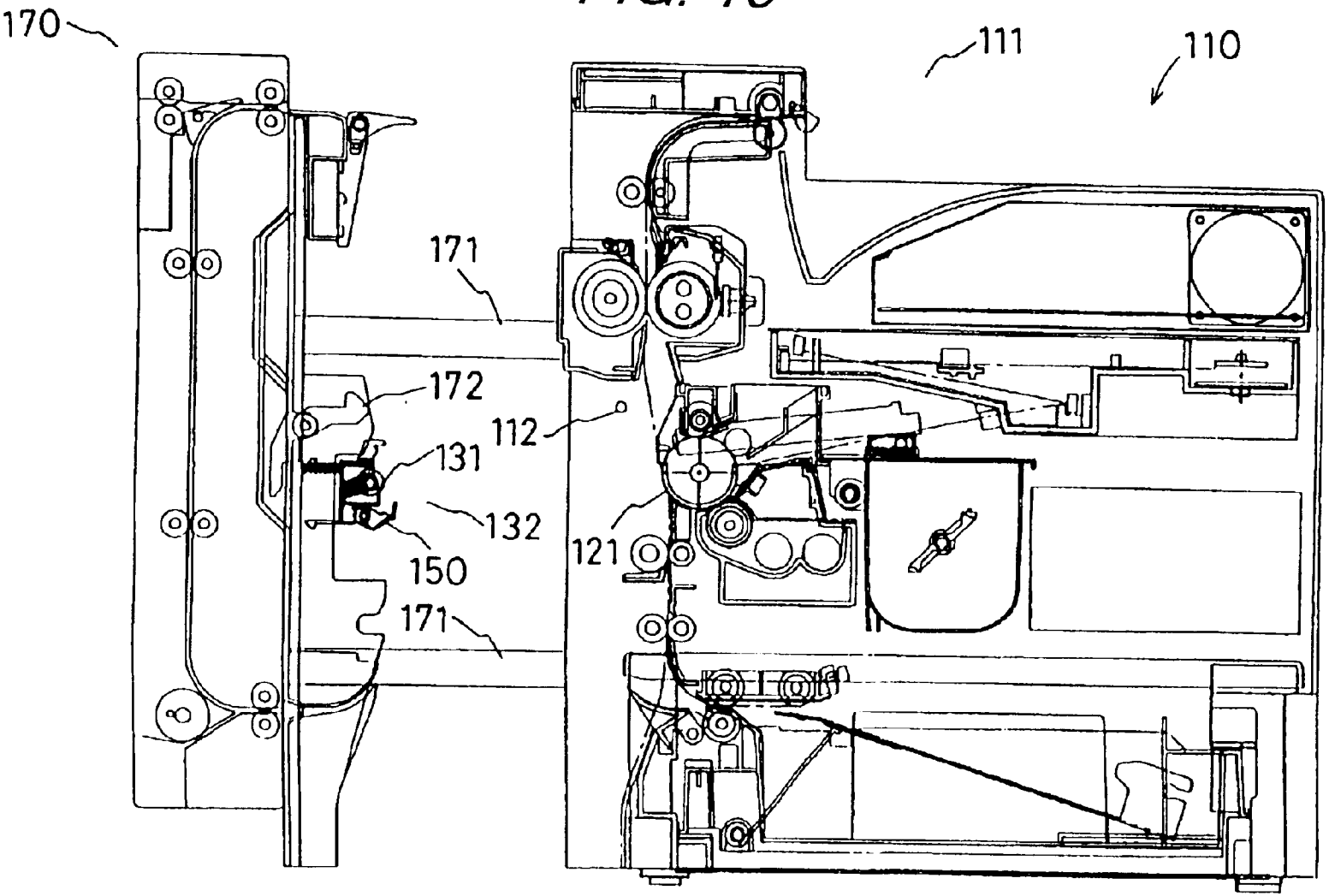
FIG. 15 is a cross sectional view showing the image forming apparatus of the third embodiment in a state that the cover portion is opened.
Figure 16:
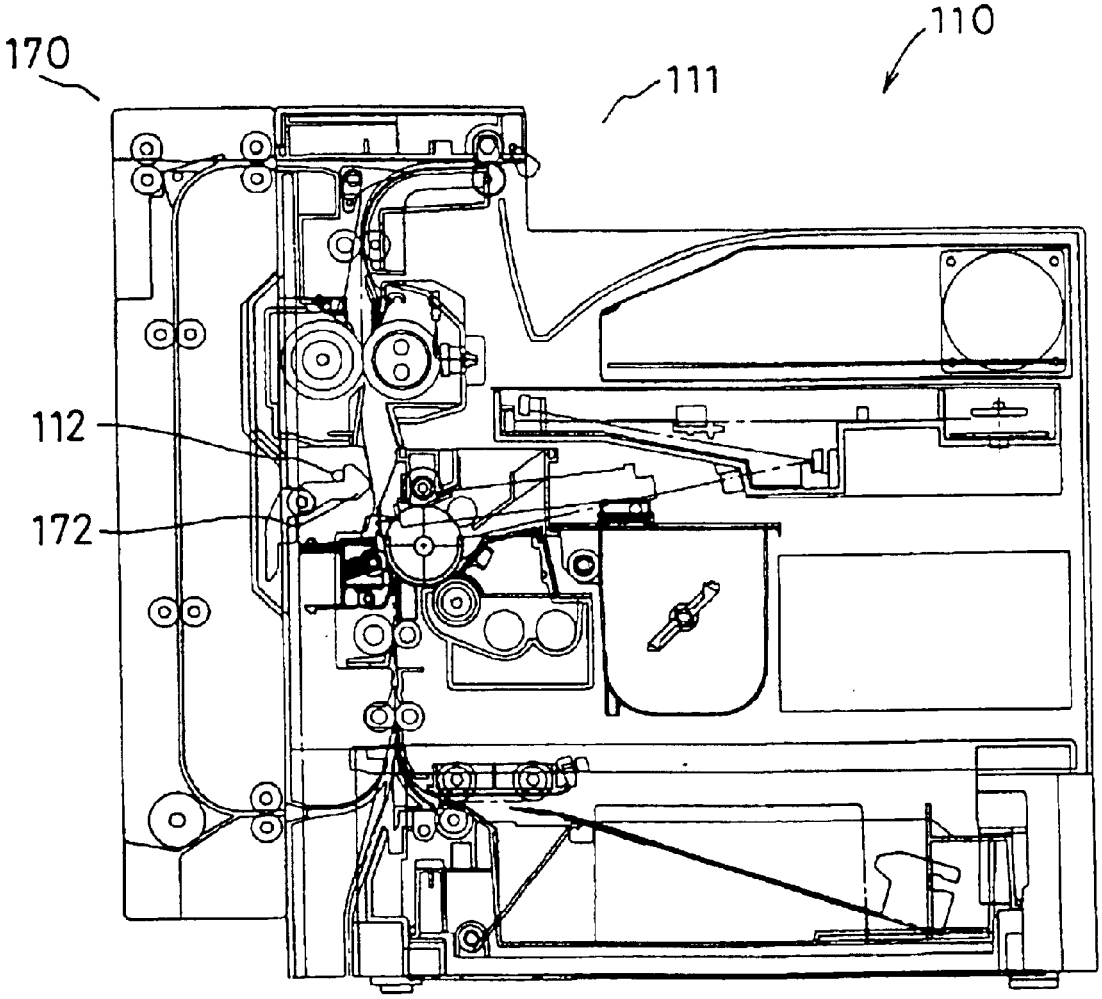
FIG. 16 is a cross sectional view showing the image forming apparatus of the third embodiment in a state that the cover portion is closed.

FIG. 11 is a sectional view illustrating principal portions of an image forming apparatus 110, with its cover portion kept in an opened state, in accordance with a third embodiment of the invention; FIG. 12 is a sectional view illustrating the principal portions of the image forming apparatus 110 of the third embodiment, with its cover portion kept in a closed state; FIG. 13 is a perspective view illustrating a transfer device of the image forming apparatus 110 of the third embodiment, with its paper guide kept in an opened state; FIG. 14 is a perspective view illustrating the transfer device of the image forming apparatus 110 of the third embodiment, with its paper guide kept in a closed state; FIG. 15 is a sectional view illustrating the image forming apparatus 110 of the third embodiment, with its cover portion kept in an opened state; and FIG. 16 is a sectional view illustrating the image forming apparatus 110 of the third embodiment, with its cover portion kept in a closed state.

The image forming apparatus 110 is a copying machine which is an example of an image forming apparatus embodying the invention.

First, the schematic structure of the image forming apparatus 110 will be described with reference to FIG. 15. FIG. 15 shows the image forming apparatus 110 when viewed from the left-hand side. The image forming apparatus 110 is roughly composed of a main body 111 and a cover portion 170. The cover portion 170 (being an example of the cover member) is provided with a rail 171 which is supported by the main body 111, and is thereby horizontally supported so as to be freely movable from the front side of the image forming apparatus 110 toward the main body 111 (in the mutually approaching or departing direction). By pressing the cover portion 170 against the main body 111, a retaining lever 172, which is rotatably supported by the cover portion 170, is brought into engagement with a retaining pin 112 disposed in the main body 111, whereby, as shown in FIG. 16, the cover portion 170 is held in engagement with the main body 111, i.e. is brought into a closed state. Moreover, by detaching the retaining lever 172 from the retaining pin 112, the cover portion 170 is disengaged from the main body 111, so that the cover portion 170 is moved away from the main body 111, i.e. is brought into an opened state.

Next, with reference to FIG. 11, the structures of the principal portions of the image forming apparatus 110 will be described. The main body 111 includes: a photoconductive drum 121 for forming a toner image on the circumferential surface thereof (an example of the image carrier); a charging device 201 for applying static charges to the photoconductive drum 121; a development device 202 for forming a toner image on the circumferential surface of the photoconductive drum 121; a cleaning device 203 for removing the toner remaining on the photoconductive drum 121 after the transferring of the toner image onto a paper sheet (an example of the transfer material) or the like; a paper supply roller 204 for feeding a paper sheet or the like from below upward to a transfer position; and a main body frame 120 which is a member for supporting the photoconductive drum 121 and other components (an example of the image carrier supporting means).

Moreover, the cover portion 170 loosely supports a transfer device frame 130 (an example of the transfer member supporting means) for supporting specific devices involved in image transfer, and is provided with a first spring 141 (an example of the transfer member supporting means urging mechanism) for urging the transfer device frame 130 to be pressed against the main body 111 in said mutually approaching or departing direction. Further, the transfer device frame 130 supports a transfer roller 131 (an example of the transfer member) for transferring a toner image onto a paper sheet or the like by being brought into pressed contact with the circumferential surface of the photoconductive drum 121; a paper guide 150 (an example of the guide member) for guiding the paper sheet or the like fed from the paper supply roller 204 to the transfer position; and a charge removal device 160 (an example of the charge removal means) for removing charges remaining on the paper sheet or the like after the toner image transfer. In addition, the transfer device frame 130 is provided with a second spring 142 (an example of the transfer member urging mechanism) for urging a rotary shaft 131*a* of the transfer roller 131 to be pressed in a predetermined direction. In this way, an image transfer device 132 is constructed.

The photoconductive drum 121 is horizontally supported by the main body frame 120 so as to be rotatable about a rotary shaft 121*a* (a first rotary shaft) which is perpendicular to the mutually approaching or departing direction. In the vicinity thereof are disposed the charging device 201, the development device 202, the cleaning device 203, and other components. Moreover, below the photoconductive drum 121 is disposed the paper supply roller 204.

The transfer device frame 130 has a fitting pin 130*c* formed so as to protrude toward the main body 111, and the main body frame 120 has a fitting hole 120*c* in which the fitting pin 130*c* is fitted. The fitting hole 120*c* is so configured that, when receiving the fitting pin 130*c*, upper and lower surfaces of the fitting pin 130*c* are brought into contact with the inner surface thereof.

The transfer device frame 130 has a hemispherical abutment part 130*a* (an example of the first positioning means) which abuts against a first abutment surface 120*a* constituting a part of the main body 111 in a state where the cover portion is closed. Likewise, the paper guide 150 has an abutment part 150*b* (an example of the second positioning means) which abuts against an abutment surface 120*b* of the main body 111.

The transfer device frame 130 is supported by the cover portion 170 so as to be slidable in the mutually approaching or departing direction. The first spring 141 is disposed between the abutment parts 130*a* and 150*b*, as viewed in the vertical direction, and has its one end supported by the cover portion 170, and has its other end arranged so as to urge the transfer device frame 130 to be pressed against the main body 111 in the mutually approaching or departing direction.

The transfer roller 131 has, on its circumferential surface, a formed material, such as urethane rubber, for bringing a paper sheet or the like into intimate contact with the circumferential surface of the photoconductive drum 121.

The transfer roller 131 has a rotary shaft 131*a* (a second rotary shaft) arranged parallel to the rotary shaft 121*a* of the photoconductive drum 121. The second rotary shaft 131*a* is rotatably supported by a groove portion 130*d* so as to be slidable obliquely upwardly. The groove portion 130*d* has a width which is substantially equal to the diameter of the second rotary shaft 131*a*. The second spring 142 has its one end supported by the groove portion 130*d*, and has its other end configured so as to push the second rotary shaft 131*a* obliquely upwardly. The sliding direction of the rotary shaft 131*a* is so determined that the rotary shaft 131*a* slides toward the rotary shaft 121*a* of the photoconductive drum 121 in a state where the cover portion is closed. Moreover, the relationship between the first and second springs 141 and 142 is such that the latter is smaller in pressing force in the mutually approaching or departing direction than the former.

The paper guide 150 is supported by the transfer device frame 130 so as to be vertically rotatable about a shaft 150*a*, arranged parallel to the rotary shaft 121*a* of the photoconductive drum 121, within a predetermined range of rotation.

The charge removal device 160, which is supported in close proximity to the upper part of the transfer roller 131, is constituted by a point discharge electrode or the like, and is supported by the transfer device frame 130.

As shown in FIG. 13, the transfer device frame 130, the paper guide 150, and the charge removal device 160 are so formed as to extend along the direction of the rotary shaft 131*a* of the transfer roller 131 to each end of the transfer roller 131. The fitting pin 130*c* and the abutment part 130*a*, 150*b* are each arranged in twos at each end of the transfer roller 131.

The paper guide 150 is rotatably supported by the transfer device frame 130 in such a way that, when the cover portion 170 is pulled to be brought into an opened state, the paper guide 150 rotates under its own weight downwardly within the predetermined range of rotation, and is thereby held away from the transfer roller 131 (the paper guide 150 is in an opened state). FIG. 13 is a perspective view illustrating the transfer device 132 composed of the transfer device frame 130, the transfer roller 131 supported thereby, and others, with the paper guide kept in an opened state.

In this way, when the cover portion 170 is opened, the transfer roller 131, the photoconductive drum 121, and the paper guide 150 are moved away from the main body 111, and thereby the circumferential surface of the transfer roller 131 is widely exposed. This helps facilitate maintenance operations such as removal of jammed paper or cleaning of the circumferential surface of the transfer roller 131.

Moreover, when the cover portion 170 is pushed to come near the main body 111, the fitting pin 130*c* is fitted in the fitting hole 120*c*, and simultaneously part of the paper guide 150 abuts on the abutment surface 120*b* of the main body 111. This causes the paper guide 150 to rotate upwardly within the predetermined range of rotation. Further, when the cover portion 170 is pushed to be brought into the closed state, as shown in FIG. 12, by the pressing action of the second spring 142, part of the circumferential surface of the transfer roller 131 comes in pressed contact with part of the circumferential surface of the photoconductive drum 121, and the abutment part 130*a* abuts against the first abutment surface 120*a*. At the same time, the abutment part 150*b* abuts against the second abutment surface 120*b*, thereby determining the inclination of the paper guide 150. Moreover, the paper guide 150 is pressed to rotate upwardly within the predetermined range of rotation so as to be supported in close proximity to the transfer roller 131 (the paper guide 150 is in a closed state). FIG. 14 is a perspective view illustrating the transfer device 132, with the paper guide kept in a closed state. In this state, the paper guide 150 is able to, with high accuracy, guide a paper sheet or the like fed from the paper supply roller 204 to a position where the transfer roller 131*a* and the photoconductive drum 121 make pressed contact with each other.

In this way, the fitting pin 130*c* is constrained to vertical movement, thereby positioning the transfer device frame 130 with respect to the main body frame 120 in the vertical direction. At the same time, by the pressing action of the first spring 141, the abutment parts 130*a* and 150*b* are respectively kept in contact with the abutment surfaces 120*a* and 120*b* of the main body frame 120, thereby positioning the transfer device frame 130 with respect to the main body frame 120 in the mutually approaching or departing direction.

Incidentally, the second spring 142 is smaller in pressing force in the mutually approaching or departing direction than the first spring 141. In this configuration, the reaction force of the pressing action of the second spring 142 prevents the transfer device frame 130 from moving away from the main body frame 120. Moreover, the photoconductive drum 121 is supported by the main body frame 120, and the transfer roller 131, the paper guide 150, and the charge removal device 160 are respectively supported by the transfer device frame 130. Therefore, the transfer roller 131, the paper guide 150, and the charge removal device 160 are positioned with respect to the photoconductive drum 121 so that the distance therebetween is kept constant. Moreover, the contact pressure force of the transfer roller 131 with respect to the photoconductive drum 121 can be kept constant by the pressing action of the second spring 142. Further, since the pressing position of the first spring 141 is located between the abutment parts 130*a* and 150*b*, as viewed in the vertical direction, the pressing action of the first spring 141 is stabilized without being lopsidedly exerted on one of the abutment parts.

As described thus far, the transfer roller 131 and the paper guide 150 can be easily moved away from the photoconductive drum 121 simply by pulling the cover portion 170 out of the main body 111 without extra operations such as screwing. This helps facilitate maintenance operations such as removal of jammed paper or cleaning of the transfer roller 131.

Moreover, the positions of the transfer roller 131, the paper guide 150, and the charge removal device 160, as well as the inclination of the paper guide 150, with respect to the photoconductive drum 121 can be kept constant at all times simply by pressing the cover portion 170 against the main body 111. Further, even if, for example, the surface of the transfer roller 131 deteriorates with time, the transfer roller 131 and the photoconductive drum 121 can be held in a predetermined pressed contact state. This makes it possible to keep the quality of the image transferred onto a paper sheet or the like at a predetermined level.

While, in the image forming apparatus 110, the transfer roller 131 is designed to be slidably supported, it may be simply rotatably supported. To achieve this, for example, the transfer device frame 130 is provided with a supporting portion having an opening whose inner diameter is substantially equal to the diameter of the rotary shaft 131*a*, and the rotary shaft 131*a* is inserted through the opening. Also in this case, the transfer roller 131 can be correctly positioned with respect to the photoconductive drum 121.

Moreover, in the image forming apparatus 110, the second spring 142 is smaller in pressing force in the mutually approaching or departing direction than the first spring 141. In this connection, according to the result of the test conducted, the pressing force of the first spring 141 in said direction should preferably be set to be 1.5 times or more greater than that of the second spring 142. By doing so, even though vibrations take place in the apparatus, the abutment parts 130*a* and 150*b* can be inhibited from moving away from the main body frame 120.

Further, while, in the image forming apparatus 110, the pressing position of the first spring 141 is located between the abutment parts 130*a* and 150*b* as viewed in the vertical direction, it may be located, for example, in the same position as the abutment part 130*a* as viewed in the vertical direction. To achieve this, for example, the abutment part 130*a* is cylindrically shaped so as to secure a sufficiently wide contact area between the main body frame 120 and the abutment part 120*a*.

Still further, while the image forming apparatus 110 is embodied as a copying machine, image forming apparatuses to which the invention is applicable may include a printer, a facsimile machine, or the like.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

an image carrier, rotatably supported, for carrying a toner image;

a peripheral rotary body involved in image formation, which is rotatably supported in a periphery of the image carrier; and control means for controlling displacement of the peripheral rotary body in a direction proximate to the image carrier so as to maintain a predetermined positional relationship between the image carrier and the peripheral rotary body, the control means being so configured that an acting point of impacting force, which is generated in between the image carrier and the peripheral rotary body at a time of image formation, is located on an axis of the image carrier between a position of an axial end portion of the image carrier and a position nearby in which the image carrier is supported, and oscillation control means for controlling oscillation of the control means.

2. The image forming apparatus of claim 1, wherein the oscillation control means is so configured as to inhibit rotation of the first and second control members.

3. The image forming apparatus of claim 1, wherein the abutment portion of the first control member, which abuts against the second control member, is so configured as to protrude outwardly relative to the other non-abutting portions.

4. The image forming apparatus of claim 1, wherein a helical gear is provided as driving force transmitting means for rotatably driving at least one of the image carrier and the peripheral rotary body.

5. An image forming apparatus comprising:

an image carrier, rotatably supported, for carrying a toner image;

a peripheral rotary body involved in image formation, which is rotatably supported in a periphery of the image carrier;

a first control member provided on a first rotary shaft of the image carrier;

a second control member provided on a second rotary shaft of the peripheral rotary body, and oscillation control means for controlling oscillation of each of the first and second control members, the first and second control members being so configured that a distance between the first and second rotary shafts is maintained at a predetermined distance by abutment of the first and second control members against each other.

6. The image forming apparatus of claim 5, wherein the oscillation control means is so configured as to inhibit rotation of the first and second control members.

7. The image forming apparatus of claim 5, wherein the abutment portion of the first control member, which abuts against the second control member, is so configured as to protrude outwardly relative to the other non-abutting portions.

8. The image forming apparatus of claim 5, wherein a helical gear is provided as driving force transmitting means for rotatably driving at least one of the image carrier and the peripheral rotary body.

* * * * *